US008951366B2

(12) United States Patent
Sano et al.

(10) Patent No.: US 8,951,366 B2
(45) Date of Patent: Feb. 10, 2015

(54) HIGH-STRENGTH COLD-ROLLED STEEL SHEET AND METHOD OF MANUFACTURING THEREOF

(75) Inventors: Kohichi Sano, Tokyo (JP); Chisato Wakabayashi, Tokyo (JP); Hiroyuki Kawata, Tokyo (JP); Riki Okamoto, Tokyo (JP); Naoki Yoshinaga, Tokyo (JP); Kaoru Kawasaki, Tokyo (JP); Natsuko Sugiura, Tokyo (JP); Nobuhiro Fujita, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 351 days.

(21) Appl. No.: 13/574,096

(22) PCT Filed: Jan. 26, 2011

(86) PCT No.: PCT/JP2011/051459

§ 371 (c)(1),
(2), (4) Date: Oct. 4, 2012

(87) PCT Pub. No.: WO2011/093319

PCT Pub. Date: Aug. 4, 2011

(65) Prior Publication Data

US 2013/0037180 A1 Feb. 14, 2013

(30) Foreign Application Priority Data

Jan. 26, 2010 (JP) ..... 2010-014363
Apr. 7, 2010 (JP) ..... 2010-088737
Jun. 14, 2010 (JP) ..... 2010-135351

(51) Int. Cl.
*C22C 38/02* (2006.01)
*C22C 38/04* (2006.01)

(Continued)

(52) U.S. Cl.
CPC ..... *C22C 38/02* (2013.01); *C21D 8/0436* (2013.01); *C21D 8/0473* (2013.01); *C22C 38/04* (2013.01); *C23C 2/04* (2013.01); *C23C 2/26* (2013.01); *C23C 2/28* (2013.01); *C21D 9/48* (2013.01); *C21D 2211/001* (2013.01); *C21D 2211/002* (2013.01); *C21D 2211/008* (2013.01); *C22C 38/06* (2013.01)
USPC ..... 148/320; 148/332; 148/333; 148/334; 148/335; 148/336; 148/337; 148/330; 148/331; 148/603; 148/505; 148/504; 148/533; 148/652; 148/664

(58) Field of Classification Search
None
See application file for complete search history.

(56) References Cited

FOREIGN PATENT DOCUMENTS

| | | |
|---|---|---|
| JP | 61-217529 | 9/1986 |
| JP | 05-059429 | 3/1993 |
| JP | 2000-045031 | 2/2000 |
| JP | 2003-183775 | 7/2003 |
| JP | 2004-269947 | 9/2004 |
| JP | 2004-330230 | 11/2004 |

(Continued)

OTHER PUBLICATIONS

International Search Report dated Apr. 26, 2011, issued in corresponding PCT Application No. PCT/JP2011/051459.

*Primary Examiner* — Deborah Yee
(74) *Attorney, Agent, or Firm* — Kenyon & Kenyon LLP

(57) ABSTRACT

A high-strength cold-rolled steel sheet includes, by mass %, C: 0.10% to 0.40%, Mn: 0.5% to 4.0%, Si: 0.005% to 2.5%, Al: 0.005% to 2.5%, Cr: 0% to 1.0%, and a balance of iron and inevitable impurities, in which an amount of P is limited to 0.05% or less, an amount of S is limited to 0.02% or less, an amount of N is limited to 0.006% or less, the microstructure includes 2% to 30% of retained austenite by area percentage, martensite is limited to 20% or less by area percentage in the microstructure, an average particle size of cementite is 0.01 μm to 1 μm, and 30% to 100% of the cementite has an aspect ratio of 1 to 3.

19 Claims, 6 Drawing Sheets

(51) Int. Cl.

| | |
|---|---|
| ***C22C 38/06*** | (2006.01) |
| ***C22C 38/18*** | (2006.01) |
| ***C21D 8/02*** | (2006.01) |
| ***C21D 8/04*** | (2006.01) |
| ***C23C 2/04*** | (2006.01) |
| ***C23C 2/26*** | (2006.01) |
| ***C23C 2/28*** | (2006.01) |
| *C21D 9/48* | (2006.01) |

(56) References Cited

FOREIGN PATENT DOCUMENTS

| | | |
|---|---|---|
| JP | 2007-111765 | 5/2007 |
| JP | 2007-224416 | 9/2007 |
| JP | 2009-215571 | 9/2009 |
| JP | 2010-047786 | 3/2010 |
| JP | 2010-255090 | 11/2010 |
| JP | 2010-255091 | 11/2010 |

HIGH-STRENGTH COLD-ROLLED STEEL SHEET AND METHOD OF MANUFACTURING THEREOF

FIELD OF THE INVENTION

The present invention relates to a high-strength cold-rolled steel sheet and a method of manufacturing thereof.

This application is a national stage application of International Application No. PCT/JP2011/051459, filed Sep. 14, 2010, which claims priority to Japanese Patent Application No. 2010-14363, filed Jan. 26, 2010, Japanese Patent Application No. 2010-88737, filed Apr. 7, 2010, and Japanese Patent Application No. 2010-135351, filed Jun. 14, 2010, the contents of which are incorporated herein by reference.

DESCRIPTION OF RELATED ART

In order to achieve weight reduction and safety, a steel sheet used for structures of automobile bodies needs to have favorable formability and strength. In particular, elongation is the most important characteristic for formability. However, generally, when the strength of a steel sheet increases, elongation and hole expansion degrade, and formability of a high-strength steel sheet (high tensile strength steel sheet) deteriorates.

In order to solve such deterioration of formability, Patent Citations 1 and 2 disclose steel sheets having retained austenite left in the steel sheet (TRIP steel sheet). In these steel sheets, since transformation induced plasticity (the TRIP effect) is used, extremely large elongation can be obtained in spite of a high strength.

In the steel sheets disclosed in Patent Citations 1 and 2, the amount of C and the amount of Si increase so that the strength of the steel sheet increases and C is concentrated in austenite. The concentration of C in austenite stabilizes retained austenite so that austenite (retained austenite) remains stably at room temperature.

In addition, as a technique that utilizes the TRIP effect more effectively, Patent Citation 3 discloses a technique in which a hydroforming is carried out in a temperature range in which the retained percentage of austenite becomes 60% to 90% at the maximum stress point. In this technique, the pipe expansion ratio is improved by 150% compared to at room temperature. In addition, in order to improve the deep drawability of TRIP steel, Patent Citation 4 discloses a forming technique that heats a die.

However, in the technique disclosed in Patent Citation 3, the application of the technique is limited to pipes. In addition, in the technique disclosed in Patent Citation 4, heating of a die for obtaining a sufficient effect is costly, and therefore the application of the technique is restrictive.

Therefore, in order to effectively develop the TRIP effect through improvement of a steel sheet instead of improvement of the forming techniques, additional addition of C to the steel sheet is considered. C added to the steel sheet concentrates in austenite, but coarse carbides precipitate at the same time. In such a case, the amount of retained austenite in the steel sheet decreases, elongation deteriorates, and cracks occur from the carbides during hole expansion.

In addition, when the amount of C is further increased in order to compensate for the decrease in amount of retained austenite caused by the precipitation of the carbides, weldability degrades.

In a steel sheet that is used for structures of automobile bodies, it is necessary to secure the balance between strength and formability (elongation and hole expansion) while increasing the strength. However, as described above, it has been difficult to secure sufficient formability only by adding C to steel.

Here, the retained austenite steel (TRIP steel sheet) is a high-strength steel sheet in which austenite is left in the microstructure of the steel sheet that is to be formed by controlling the ferrite transformation and the bainite transformation during annealing so as to increase the concentration of C in austenite. Due to the TRIP effect of the retained austenite, the retained austenite steel has large elongation.

The TRIP effect has a temperature dependency, and thus the TRIP effect could be utilized to the maximum extent by forming a steel sheet at a high temperature of higher than 250° C. in the case of the TRIP steel of the conventional techniques. However, in a case in which the forming temperature exceeds 250° C., problems are liable to occur regarding the heating costs for a die. Therefore, it is desirable to make it possible to use the TRIP effect to the maximum extent at room temperature and in a temperature range of 100° C. to 250° C.

PATENT CITATION

[Patent Citation 1] Japanese Unexamined Patent Application, First Publication No. S61-217529

[Patent Citation 2] Japanese Unexamined Patent Application, First Publication No. H05-59429

[Patent Citation 3] Japanese Unexamined Patent Application, First Publication No. 2004-330230

[Patent Citation 4] Japanese Unexamined Patent Application, First Publication No. 2007-111765

SUMMARY OF THE INVENTION

Problems to be Solved by the Invention

An object of the present invention is to provide a steel sheet that can suppress cracking during hole expansion and is excellent in terms of the balance between strength and formability.

Methods for Solving the Problem

The inventors succeeded in manufacturing a steel sheet that is excellent in terms of strength, ductility (elongation), and hole expansion by optimizing the chemical compositions in steel and manufacturing conditions and controlling the size and shape of carbides during annealing. The purport is as follows.

(1) A high-strength cold-rolled steel sheet according to an aspect of the present invention includes, by mass %, C: 0.10% to 0.40%, Mn: 0.5% to 4.0%, Si: 0.005% to 2.5%, Al: 0.005% to 2.5%, Cr: 0% to 1.0%, and a balance of iron and inevitable impurities, in which the amount of P is limited to 0.05% or less, the amount of S is limited to 0.02% or less, the amount of N is limited to 0.006% or less, and the microstructure includes 2% to 30% of retained austenite by area percentage and martensite is limited to 20% or less by area percentage in the microstructure, an average particle size of cementite is 0.01 μm to 1 μm, and 30% to 100% of the cementite has an aspect ratio of 1 to 3.

(2) The high-strength cold-rolled steel sheet according to the above (1) may further includes, by mass %, one or more kinds of Mo: 0.01% to 0.3%, Ni: 0.01% to 5%, Cu: 0.01% to 5%, B: 0.0003% to 0.003%, Nb: 0.01% to 0.1%, Ti: 0.01% to 0.2%, V: 0.01% to 1.0%, W: 0.01% to 1.0%, Ca: 0.0001% to 0.05%, Mg: 0.0001% to 0.05%, Zr: 0.0001% to 0.05%, and REM: 0.0001% to 0.05%.

(3) In the high-strength cold-rolled steel sheet according to the above (1) or (2), the total amount of Si and Al may be 0.5% to 2.5%.

(4) In the high-strength cold-rolled steel sheet according to the above (1) or (2), the average grain size of the retained austenite may be 5 μm or less.

(5) In the high-strength cold-rolled steel sheet according to the above (1) or (2), the microstructure may include, by area percentage, 10% to 70% of ferrite.

(6) In the high-strength cold-rolled steel sheet according to the above (1) or (2), the microstructure may include, by area percentage, 10% to 70% of ferrite and bainite in total.

(7) In the high-strength cold-rolled steel sheet according to the above (1) or (2), the microstructure may include, by area percentage, 10% to 75% of bainite and tempered martensite in total.

(8) In the high-strength cold-rolled steel sheet according to the above (1) or (2), the average grain size of the ferrite may be 10 μm or less.

(9) In the high-strength cold-rolled steel sheet according to the above (1) or (2), the cementite having an aspect ratio of 1 to 3 may be included in 0.003 particles/$\mu m^2$ to 0.12 particles/$\mu m^2$.

(10) In the high-strength cold-rolled steel sheet according to the above (1) or (2), in the central portion of the sheet thickness, the random intensity ratio X of a {100} <001> orientation of the retained austenite and the average value Y of the random intensity ratio of a {110} <111> to {110} <001> orientation group of the retained austenite may satisfy the following equation (1)

$$4<2X+Y<10 \quad (1).$$

(11) In the high-strength cold-rolled steel sheet according to the above (1) or (2), in the central portion of the sheet thickness, the ratio of the random intensity ratio of a {110} <111> orientation of the retained austenite to the random intensity ratio of a {110} <001> orientation of the retained austenite may be 3.0 or less.

(12) In the high-strength cold-rolled steel sheet according to the above (1) or (2), a zinc coating may be further provided on at least one surface.

(13) In the high-strength cold-rolled steel sheet according to the above (1) or (2), a galvannealed coating may be further provided on at least one surface.

(14) A method of manufacturing a high-strength cold-rolled steel sheet according to an aspect of the present invention includes a first process in which a slab having the chemical composition according to the above (1) or (2) is hot-rolled at a finishing temperature of 820° C. or higher so as to produce a hot-rolled steel sheet; a second process in which, after the first process, the hot-rolled steel sheet is cooled and coiled in a coiling temperature CT° C. of 350° C. to 600° C.; a third process in which the hot-rolled steel sheet that has undergone the second process is cold-rolled at a reduction in thickness of 30% to 85% so as to produce a cold-rolled steel sheet; a fourth process in which, after the third process, the cold-rolled steel sheet is heated and annealed at an average heating temperature of 750° C. to 900° C.; a fifth process in which the cold-rolled steel sheet that has undergone the fourth process is cooled at an average cooling rate of 3° C./s to 200° C./s and held in a temperature range of 300° C. to 500° C. for 15 seconds to 1200 seconds; and a sixth process in which the cold-rolled steel sheet that has undergone the fifth process is cooled, in which, in the second process, a first average cooling rate CR1° C./s from 750° C. to 650° C. is 15° C./s to 100° C./s, a second average cooling rate CR2° C./s from 650° C. to the coiling temperature CT° C. is 50° C./s or less, a third average cooling rate CR3° C./s from after coiling to 150° C. is 1° C./s or less, the coiling temperature CT° C. and the first average cooling rate CR1° C./s satisfy the following equation (2), and, in the fourth process, in a case in which the amounts of Si, Al, and Cr are represented by [Si], [Al], and [Cr] in terms of mass %, respectively, the average area S $\mu m^2$ of pearlite included in the hot-rolled steel sheet that has undergone the second process, the average heating temperature T° C., and the heating time is satisfy the relationship of the following equation (3).

$$1500 \le CR1 \times (650-CT) \le 15000 \quad (2)$$

$$2200 > T \times \log(t)/(1+0.3[Si]+0.5[Al]+[Cr]+0.5S) > 110 \quad (3)$$

(15) In the method of manufacturing the high-strength cold-rolled steel sheet according to the above (14), the total of the reduction in thickness of the last two steps in the first process may be 15% or more.

(16) In the method of manufacturing the high-strength cold-rolled steel sheet according to the above (14), the cold-rolled steel sheet that has undergone the fifth process and is to undergo the sixth process may be coated with zinc.

(17) In the method of manufacturing the high-strength cold-rolled steel sheet according to the above (14), the cold-rolled steel sheet that has undergone the fifth process and is to undergo the sixth process may be galvanized and annealed in 400° C. to 600° C. for alloying.

(18) In the method of manufacturing the high-strength cold-rolled steel sheet according to the above (14), the average heating rate from 600° C. to 680° C. in the fourth process may be 0.1° C./s to 7° C./s.

(19) In the method of manufacturing the high-strength cold-rolled steel sheet according to the above (14), before the first process, the slab may be cooled to 1000° C. or lower and reheated to 1000° C. or higher.

Effects of the Invention

According to the present invention, it is possible to provide a high-strength steel sheet that is excellent in terms of strength and formability (elongation and hole expansion at room temperature and in a warm range) by optimizing the chemical composition, securing a predetermined amount of retained austenite, and appropriately controlling the size and shape of cementite.

In addition, according to the present invention, it is possible to manufacture a high-strength steel sheet that is excellent in terms of strength and formability by appropriately controlling the cooling rate of the steel sheet after hot rolling (before and after coiling) and the annealing conditions after cold rolling.

In addition, in the high-strength cold-rolled steel sheet according to the above (4), elongation can be further improved in a warm range.

Furthermore, in the high-strength cold-rolled steel sheet according to the above (10), it is possible to secure high uniform elongation in any directions while in-plane anisotropy is rarely exhibited.

DETAILED DESCRIPTION OF THE INVENTION

Figure 1:
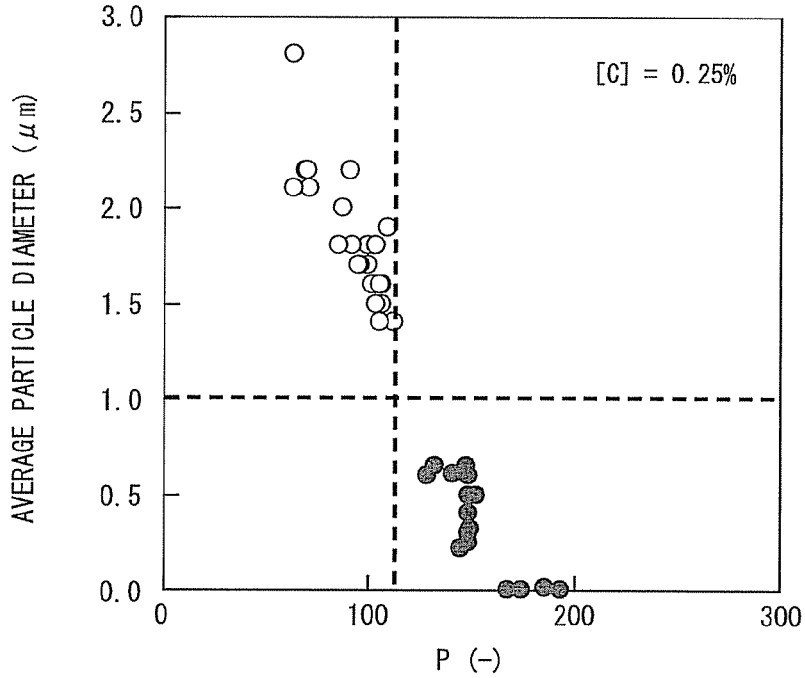
FIG. 1 is a graph showing the relationship between the annealing parameter P and the average particle size of cementite.

The inventors found out that the balance between strength and formability (ductility and hole expansion) becomes excellent when cementite formed during hot rolling is melted during heating for annealing so as to decrease the particle size of the cementite in a steel sheet. Hereinafter, the reasons will be described.

In TRIP steel, C is concentrated in austenite so as to increase the amount of retained austenite in a process of annealing. An increase in the amount of C in the austenite and an increase in the amount of austenite improve the tensile properties of the TRIP steel. However, in a case in which cementite formed during hot rolling remains after annealing (annealing after cold rolling), some of C added to the steel is present in the form of carbides. In this case, there are cases in which the amount of the austenite and the amount of C in the austenite decrease, and the balance between strength and ductility deteriorates. In addition, the carbides act as starting points of cracking during hole expansion tests, and formability deteriorates.

The reasons are not clear, but are considered to be as follows. When the particle size of the cementite decreases to a critical size or less, deterioration of local elongation originating from the cementite is prevented, and solute C that is obtained by dissolving the cementite can be concentrated in the austenite. Furthermore, in this case, the area ratio of retained austenite and the amount of C in the retained austenite increase, and the stability of the retained austenite increases. As a result, the TRIP effect improves due to the synergy effect of the prevention of deterioration of local elongation originating from the cementite and improvement in the stability of the retained austenite.

In order to effectively exhibit the synergy effect, the average particle size of the cementite needs to be 0.01 μm to 1 μm after annealing. In order to more reliably prevent deterioration of local elongation and further increase the amount of C supplied to the retained austenite from the cementite, the average particle size (average particle diameter) of the cementite is preferably 0.9 μm or less, more preferably 0.8 μm or less, and most preferably 0.7 μm or less. When the average particle size of the cementite exceeds 1 μm, since C does not concentrate sufficiently, the TRIP effect is not optimal in a temperature range of 100° C. to 250° C. as well as at room temperature, local elongation deteriorates due to coarse cementite, and elongation abruptly deteriorates due to the synergistic action. On the other hand, though the average particle size of the cementite is desirably as small as possible, the average particle size needs to be 0.01 μm or more in order to suppress the grain growth of ferrite. In addition, as described below, the average particle size of the cementite is dependent on heating temperature and heating time during annealing. Therefore, from an industrial viewpoint as well as the viewpoint of microstructure control, the average particle size of the cementite is preferably 0.02 μm or more, more preferably 0.03 μm or more, and most preferably 0.04 μm or more.

Meanwhile, the average particle size of the cementite is obtained by averaging the equivalent circle diameters of the cementite particles when the cementite in the microstructure of the steel sheet is observed using an optical microscope, an electron microscope, or the like.

The inventors investigated a method for decreasing the average particle size of the cementite. The inventors studied the relationship between the average area of pearlite in a hot-rolled steel sheet and the amount of cementite dissolved depending on heating temperature and heating time during annealing.

As a result, it was found that, when the average area S ($\mu m^2$) of pearlite in the microstructure of the steel sheet after hot rolling, the average heating temperature T (° C.) during annealing, and the heating time t (s) during annealing satisfy the following equation (4), the average particle size of the cementite after annealing becomes 0.01 μm to 1 μm, and concentration of C in the retained austenite phases is accelerated as shown in FIG. 1. Meanwhile, in FIG. 1, in order to eliminate the influence of the amount of carbon, steel having an amount of C of approximately 0.25% is used, and the cementite is observed using an optical microscope.

$$2200>T\times\log(t)/(1+0.3[Si]+0.5[Al]+[Cr]+0.5S)>110 \quad (4)$$

Herein, [Si], [Al], and [Cr] represent the amounts (mass %) of Si, Al, and Cr in a steel sheet, respectively. In addition, log in the equation (4) indicates a common logarithm (with a base of 10).

Here, in order to simplify the following description, annealing parameters P and α are introduced which are represented in the following equations (5) and (6).

$$P=T\times\log(t)/\alpha \quad (5)$$

$$\alpha=(1+0.3[Si]+0.5[Al]+[Cr]+0.5S) \quad (6)$$

The lower limit of the annealing parameter P is required in order to decrease the average particle size of the cementite. In order to decrease the average particle size of the cementite to 1 μm or less, it is necessary to carry out annealing under conditions of an annealing parameter P of more than 110. In addition, the upper limit of the annealing parameter P is required to reduce the costs necessary for annealing and secure cementite that pins the ferrite grain. In order to secure cementite having an average particle size of 0.01 μm or more that can be used for the pinning, it is necessary to carry out annealing under conditions of an annealing parameter P of less than 2200. As such, the annealing parameter P needs to be more than 110 to less than 2200.

Meanwhile, in order to further decrease the average particle size of the cementite as described above, the annealing parameter P is preferably more than 130, more preferably more than 140, and most preferably more than 150. In addition, in order to sufficiently secure the average particle size of the cementite that can be used for pinning as described above, the annealing parameter P is preferably less than 2100, more preferably less than 2000, and most preferably less than 1900.

When the above equation (4) is satisfied, cementite in pearlite formed during coiling of the steel sheet after hot rolling is spheroidized during heating for annealing, and relatively large spherical cementite is formed in the middle of annealing. The spherical cementite can be dissolved at an annealing temperature of $A_{c1}$ point or higher, and, when the equation (4) is satisfied, the average particle size of the cementite sufficiently decreases so as to be 0.01 μm to 1 μm.

Here, the physical meanings of the terms of the annealing parameter P (the equation (5)) will be described.

T×log(t) in the annealing parameter P is considered to be associated with the diffusion rates (or diffusion amounts) of carbon and iron. This is because reverse transformation from cementite to austenite proceeds as the atoms diffuse.

α in the annealing parameter P increases in a case in which the amounts of Si, Al, and Cr are large, or the average area S of pearlite that forms during coiling of the hot-rolled steel sheet is large. In order to satisfy the equation (4) in a case in which α is large, it is necessary to change the annealing conditions so that T×log(t) increases.

The reasons why α (the equation (6)) in the equation (5) changes by the amounts of Si, Al, and Cr and the area ratio of pearlite after coiling of the hot-rolled steel sheet are as follows.

Si and Al are elements that suppress precipitation of cementite. Therefore, when the amounts of Si and Al increase, transformation from austenite to ferrite and bainite having a small amount of carbides becomes liable to proceed during coiling of the steel sheet after hot rolling, and carbon concentrates in austenite. After that, transformation from austenite in which carbon concentrates to pearlite occurs. In such pearlite having a high carbon concentration, since the fraction of cementite is large, and cementite in pearlite is liable to spheroidize and hard to be dissolved during the subsequent heating for annealing, coarse cementite is liable to be formed. As such, the terms including [Si] and [Al] in α are considered to correspond to lowering of the rate of solution of cementite due to formation of coarse cementite and an increase in the solution time.

Cr is an element that forms a solid solution in cementite so as to make it difficult to dissolve cementite (so as to stabilize cementite). Therefore, when the amount of Cr increases, the value of α in the equation (5) increases. As such, the terms including [Cr] in α is considered to correspond to lowering of the rate of solution of cementite due to stabilization of cementite.

It is considered that, when the average area S of pearlite is relatively large after coiling of the hot-rolled steel sheet, the diffusion distance of atoms necessary for the reverse transformation becomes large, and therefore the average particle size of annealed cementite is liable to become large. Therefore, when the average area S of pearlite increases, a in the equation (5) increases. As such, the term including the average area S of pearlite in α is considered to correspond to an increase in the solution time of cementite due to an increase in the diffusion distance of atoms.

For example, the average area S of the pearlite is obtained by measuring the area of a statistically sufficient number of pearlite grains through an image analysis of an optical micrograph of a cross section of the hot-rolled steel sheet, and averaging the areas thereof.

As such, α is a parameter that indicates how easily cementite remains after annealing, and it is necessary to determine annealing conditions according to α so as to satisfy the above equation (4).

Figure 2:
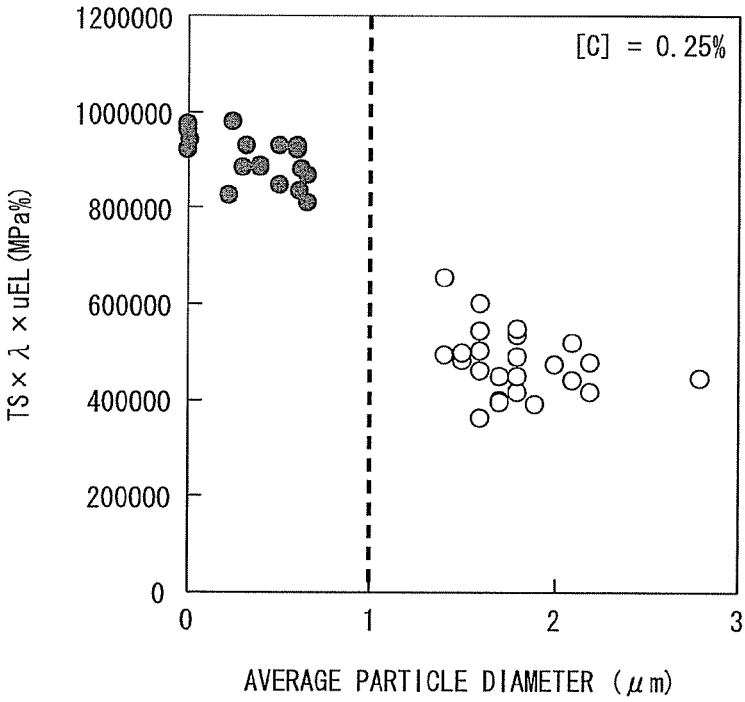
FIG. 2 is a graph showing the relationship between the average grain size of cementite and the balance between strength and formability (product of tensile strength TS, uniform elongation uEL, and hole expansion λ).
Figure 3:
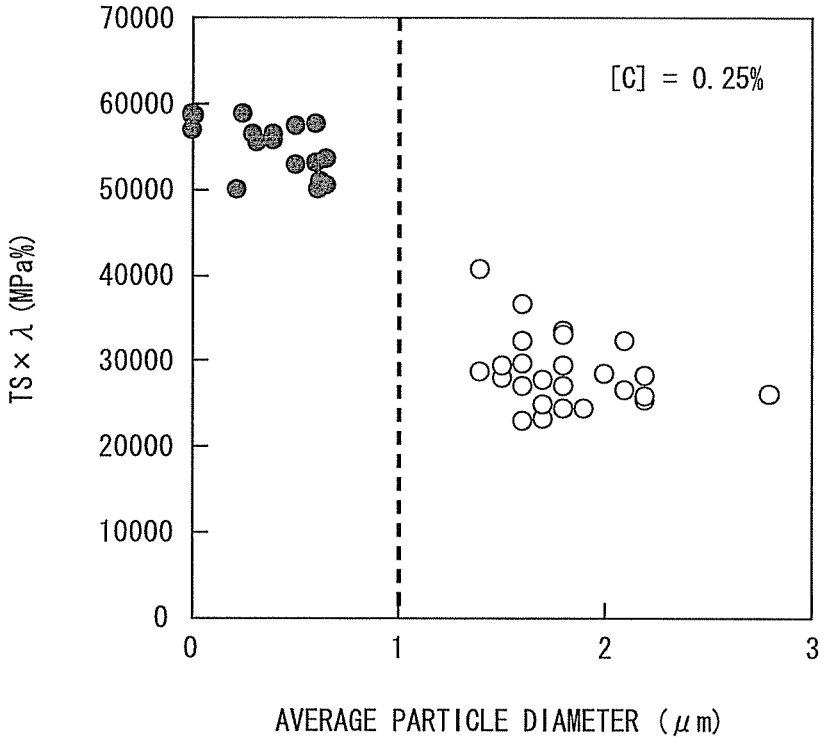
FIG. 3 is a graph showing the relationship between the average grain size of cementite and the balance between strength and formability (product of tensile strength TS and hole expansion λ).

As such, when annealing is carried out under annealing conditions that satisfy the equation (4), the average particle size of the cementite sufficiently decreases, the cementite is suppressed from acting as a starting point of rupture during hole expansion, and the total amount of C that concentrates in austenite increases. Therefore, the amount of retained austenite in the microstructure increases, and the balance between strength and ductility improves. For example, the balance between strength and formability improves in a case in which the average particle size of the cementite present in steel is 1 μm or less as shown in FIGS. 2 and 3. Meanwhile, in FIG. 2, the balance between strength and formability of the steel sheet shown in FIG. 1 is evaluated using the product of tensile strength TS, uniform elongation uEL, and hole expansion λ. In addition, in FIG. 3, the balance between strength and formability of the steel sheet shown in FIG. 1 is evaluated using the product of tensile strength TS and hole expansion λ.

In addition, as a result of thorough studies, the inventors found that, in a case in which it is necessary to decrease in-plane anisotropy during forming, it is extremely important to control the crystal orientation (texture) of austenite phases. In order to control the texture of austenite phases, it is extremely important to control the texture of ferrite formed during annealing. Since the retained austenite phases remaining in a sheet product are formed due to reverse transformation from the interfaces of ferrite phases during annealing, the retained austenite phases are significantly influenced by the crystal orientation of the ferrite phases.

Therefore, in order to decrease in-plane anisotropy, it is important to control the texture of ferrite to be transformed to austenite and make austenite inherit the crystal orientation during the subsequent reverse transformation. That is, in order to optimize the texture of ferrite, the coiling temperature during hot rolling is controlled, the hot-rolled sheet is prevented from having a microstructure of bainite single phase, and the hot-rolled sheet is cold-rolled at an appropriate reduction in thickness. A desired crystal orientation can be produced through such control. In addition, in order to make the austenite phases inherit the texture of the ferrite phases, it is important to sufficiently recrystallize the cold-rolled microstructure during annealing, increase the temperature to a two-phase region, and optimize the fraction of austenite in the two-phase region. Therefore, in order to increase the stability of the retained austenite as much as possible, in a case in which it is necessary to decrease in-plane anisotropy during forming, it is desirable to control the above conditions appropriately.

Hereinafter, the high-strength cold-rolled steel sheet (for examples, having a tensile strength of 500 MPa to 1800 MPa) according to an embodiment of the present invention will be described in detail.

Firstly, the basic components of the steel sheet of the embodiment will be described. Meanwhile, in the following, "%" that indicates the amounts of the chemical elements refers to mass %.

C: 0.10% to 0.40%

C is an extremely important element to increase the strength of steel and secure retained austenite. In order to secure a sufficient amount of retained austenite, an amount of C of 0.10% or more is required. On the other hand, when C is excessively included in steel, weldability is impaired, and therefore the upper limit of the amount of C is 0.40%. In addition, in order to secure more retained austenite and increase the stability of retained austenite, the amount of C is preferably 0.12% or more, more preferably 0.14% or more, and most preferably 0.16% or more. In order to further secure weldability, the amount of C is preferably 0.36% or less, more preferably 0.33% or less, and most preferably 0.32% or less.

Mn: 0.5% to 4.0%

Mn is an element that stabilizes austenite and increases hardenability. In order to secure sufficient hardenability, an amount of Mn of 0.5% or more is required. On the other hand, when Mn is excessively added to steel, ductility is impaired, and therefore the upper limit of the amount of Mn is 4.0%. The preferable upper limit of the amount of Mn is 2.0%. In order to further increase the stability of austenite, the amount of Mn is preferably 1.0% or more, more preferably 1.3% or more, and most preferably 1.5% or more. In addition, in order to secure more favorable formability, the amount of Mn is preferably 3.0% or less, more preferably 2.6% or less, and most preferably 2.2% or less.

Si: 0.005% to 2.5%

Al: 0.005% to 2.5%

Si and Al are a deoxidizing agent, and steel needs to include each of Si and Al of 0.005% or more in order to carry out sufficient deoxidization. In addition, Si and Al stabilize ferrite during annealing and suppress precipitation of cementite during bainite transformation so as to increase the concentration of C in austenite and contribute to securing of retained austenite. More retained austenite can be secured as the amounts of Si and Al increase, and therefore the amount of Si and the amount of Al each are preferably 0.30% or more, more preferably 0.50% or more, and most preferably 0.80% or more. When Si or Al is added excessively to steel, surface properties (for example, properties for galvannealing or chemical conversion treatment), coatability, and weldability deteriorate, and therefore the upper limits of the amount of Si and the amount of Al each are set to 2.5%. In a case in which surface properties, coatability, and weldability are required when the steel sheet is used as a part, the upper limits of the amount of Si and the amount of Al each are preferably 2.0%, more preferably 1.8%, and most preferably 1.6%.

Meanwhile, in a case in which a large amount of both Si and Al are added to steel, it is desirable to evaluate the sum (Si+Al) of the amount of Si and the amount of Al. That is, Si+Al is preferably 0.5% or more, more preferably 0.8% or more, still more preferably 0.9% or more, and most preferably 1.0% or more. In addition, Si+Al is preferably 2.5% or less, more preferably 2.3% or less, still more preferably 2.1% or less, and most preferably 2.0% or less.

Cr: 0% to 1.0%

Cr is an element that increases the strength of the steel sheet. Therefore, in a case in which Cr is added so as to increase the strength of the steel sheet, the amount of Cr is preferably 0.01% or more. However, when 1% or more of Cr is included in steel, since sufficient ductility cannot be secured, the amount of Cr needs to be 1% or less. In addition, since Cr forms solid solutions in cementite so as to stabilize the cementite, solution of cementite is suppressed (hindered) during annealing. Therefore, the amount of Cr is preferably 0.6% or less and more preferably 0.3% or less.

Next, among inevitable impurities, impurities that need to be particularly reduced will be described. Meanwhile, the lower limits of these impurities (P, S, and N) may be 0%.

P: 0.05% or Less

P is an impurity and impairs ductility and weldability when excessively included in steel. Therefore, the upper limit of the amount of P is 0.05%. In a case in which more formability is required, the amount of P is preferably 0.03% or less, more preferably 0.02% or less, and most preferably 0.01% or less.

S: 0.020% or Less

S is an impurity, and, when excessively included in steel, forms MnS elongated due to hot rolling and deteriorates formability, such as ductility, hole expansion, and the like. Therefore, the upper limit of the amount of S is 0.02%. In a case in which more formability is required, the amount of S is preferably 0.010% or less, more preferably 0.008% or less, and most preferably 0.002% or less.

N is an impurity, and, when the amount of N exceeds 0.006%, ductility deteriorates. Therefore, the upper limit of the amount of N is 0.006%. In a case in which more formability is required, the amount of N is preferably 0.004% or less, more preferably 0.003% or less, and most preferably 0.002% or less.

Hereinafter, optional elements will be described.

Furthermore, in addition to the above basic components, one or more kinds of Mo, Ni, Cu, and B may be added as necessary to steel. Mo, Ni, Cu, and B are elements that improve the strength of the steel sheet. In order to obtain the effect, the amount of Mo, the amount of Ni, and the amount of Cu each are preferably 0.01% or more, and the amount of B is preferably 0.0003% or more. In addition, in a case in which it is necessary to further secure strength, the lower limits of the amount of Mo, the amount of Ni, and the amount of Cu are more preferably 0.03%, 0.05%, and 0.05%, respectively. Similarly, the amount of B is preferably 0.0004% or more, more preferably 0.0005% or more, and most preferably 0.0006% or more. On the other hand, when these chemical elements are excessively added to steel, strength increases excessively, and there are cases in which ductility is degraded. Particularly, when B is excessively added to steel so as to increase hardenability, ferrite transformation and bainite transformation begin late, and the concentration rate of C in austenite phases decreases. In addition, in a case in which Mo is excessively added to steel, there are cases in which the texture degrades. Therefore, in a case in which ductility needs to be secured, it is desirable to control the amount of Mo, the amount of Ni, the amount of Cu, and the amount of B. Therefore, the upper limit of the amount of Mo is preferably 0.3%, and more preferably 0.25%. In addition, the upper limit of the amount of Ni is preferably 5%, more preferably 2%, still more preferably 1%, and most preferably 0.3%. The upper limit of the amount of Cu is preferably 5%, more preferably 2%, still more preferably 1%, and most preferably 0.3%. The upper limit of the amount of B is preferably 0.003%, more preferably 0.002%, still more preferably 0.0015%, and most preferably 0.0010%.

Also, in addition to the above basic components, one or more kinds of Nb, Ti, V, and W may be added as necessary to steel. Nb, Ti, V, and W are elements that form fine carbides, nitrides, or carbonitrides, and improve the strength of the steel sheet. Therefore, in order to further secure strength, the amount of Nb, the amount of Ti, the amount of V, and the amount of W each are preferably 0.01% or more, and more preferably 0.03% or more. On the other hand, when these elements are excessively added to steel, strength increases excessively such that ductility degrades. Therefore, the upper limits of the amount of Nb, the amount of Ti, the amount of V, and the amount of W are preferably 0.1%, 0.2%, 1.0%, and 1.0%, respectively, and more preferably 0.08%, 0.17%, 0.17%, and 0.17%, respectively.

Furthermore, in addition to the above basic components, 0.0001% to 0.05% of one or more kinds of Ca, Mg, Zr, and rare earth metals (REM) are preferably included in steel. Ca, Mg, Zr, and REM have an effect of controlling the shapes of sulfides and oxides so as to improve local ductility and hole expansion. In order to obtain the effect, the amount of Ca, the amount of Mg, the amount of Zr, and the amount of REM each are preferably 0.0001% or more, and more preferably 0.0005% or more. On the other hand, when these elements are excessively added to steel, formability deteriorates. Therefore, the amount of Ca, the amount of Mg, the amount of Zr, and the amount of REM each are preferably 0.05% or less, and more preferably 0.04% or less. In addition, in a case in which plural kinds of these elements are added to steel, the total amount of the elements is more preferably 0.0005% to 0.05%.

Next, the microstructure (structure) of the high-strength cold-rolled steel sheet of the embodiment will be described. The microstructure of the high-strength cold-rolled steel sheet of the embodiment needs to include retained austenite. In addition, the majority of the remaining microstructure can be classified into ferrite, bainite, martensite, and tempered martensite. Hereinafter, "%" that indicates the amount of each phase (microstructure) refers to an area percentage (area ratio). Meanwhile, since carbides, such as cementite, are dispersed in a part of phases, the area ratio of the carbides, such as cementite, is not evaluated in the area ratio of the microstructure.

Retained austenite increases ductility, particularly uniform elongation through transformation induced plasticity. Therefore, the microstructure needs to include 2% or more of retained austenite in terms of area ratio. In addition, since retained austenite is transformed into martensite through forming, retained austenite also contributes to improvement in strength. Particularly, in a case in which a relatively large amount of an element, such as C, is added to steel in order to secure retained austenite, the area ratio of retained austenite is preferably 4% or more, more preferably 6% or more, and most preferably 8% or more.

On the other hand, a larger area ratio of retained austenite is more preferable. However, in order to secure more than 30% of retained austenite in terms of area ratio, it is necessary to increase the amounts of C and Si, and weldability or surface properties are degraded. Therefore, the upper limit of the area ratio of retained austenite is 30%. In a case in which weldability and surface properties need to be further secured, the upper limit of the area ratio of retained austenite is preferably 20%, more preferably 17%, and most preferably 15%.

In addition, the size of retained austenite strongly influences the stability of retained austenite. As a result of repeated studies regarding the stability of retained austenite in a temperature range of 100° C. to 250° C., the inventors found that, when the average grain size of retained austenite is 5 μm or less, retained austenite is uniformly dispersed in steel, and the TRIP effect of retained austenite can be exhibited more effectively. That is, when the average grain size of retained austenite is set to 5 μm or less, elongation in a temperature range of 100° C. to 250° C. can be drastically improved even in a case in which elongation is low at room temperature. Therefore, the average grain size (average grain diameter) of retained austenite is preferably 5 μm or less, more preferably 4 μm or less, still more preferably 3.5 μm or less, and most preferably 2.5 μm or less.

As such, the average grain size of retained austenite is preferably small, but the average grain size is dependent on heating temperature and heating time during annealing, and thus is preferably 1.0 μm or more from an industrial viewpoint.

Since martensite is hard, strength can be secured. However, when the area ratio of martensite exceeds 20%, ductility is insufficient, and therefore it is necessary to control the area ratio of martensite to be 20% or less. In addition, in order to further secure formability, the area ratio of martensite is preferably controlled to be 15% or less, more preferably 10% or less, and most preferably 7% or less. On the other hand, when martensite is reduced, since strength degrades, the area ratio of martensite is preferably 3% or more, more preferably 4% or more, and most preferably 5% or more.

The remaining microstructure in the above microstructure includes at least one of ferrite, bainite, and tempered martensite. The area ratio thereof is not particularly limited, but is desirably in the following range of area ratio in consideration of the balance between elongation and strength.

Ferrite is a microstructure that is excellent in terms of ductility, but excessive ferrite reduces strength. Therefore, in order to obtain an excellent balance between strength and ductility, the area ratio of ferrite is preferably 10% to 70%. The area ratio of ferrite is controlled according to the target strength level. In a case in which ductility is required, the area ratio of ferrite is more preferably 15% or more, still more preferably 20% or more, and most preferably 30% or more. In addition, in a case in which strength is required, the area ratio of ferrite is more preferably 65% or less, still more preferably 60% or less, and most preferably 50% or less.

The average grain size of ferrite is preferably 10 μm or less. As such, when the average grain diameter of ferrite is 10 μm or less, the strength of a steel sheet can increase without degrading total elongation and uniform elongation. This is considered to be because, when ferrite grains are made to be fine, the microstructure becomes uniform, and therefore strains introduced during forming are uniformly dispersed, and strain concentration decreases so that it becomes hard for the steel sheet to be ruptured. In addition, in a case in which strength needs to be increased while elongation is maintained, the average grain size of ferrite is more preferably 8 μm or less, still more preferably 6 μm or less, and most preferably 5 μm or less. The lower limit of the average grain size of ferrite is not particularly limited. However, the average grain size of ferrite is preferably 1 μm or more, more preferably 1.5 μm or more, and most preferably 2 μm or more from an industrial viewpoint in consideration of tempering conditions.

In addition, ferrite and bainite are required to concentrate C in retained austenite and improve ductility through the TRIP effect. In order to obtain excellent ductility, the total of the area ratios of ferrite and bainite is preferably 10% to 70%. When the total of the area ratios of ferrite and bainite is changed in a range of 10% to 70%, it is possible to maintain favorable elongation at room temperature and in a warm range and reliably obtain a desired strength. In order to concentrate more C in retained austenite, the total amount of the area ratios of ferrite and bainite is more preferably 15% or more, still more preferably 20% or more, and most preferably 30% or more. In addition, in order to sufficiently secure the amount of retained austenite in the final microstructure, the total amount of the area ratios of ferrite and bainite is more preferably 65% or less, still more preferably 60% or less, and most preferably 50% or less.

In addition, bainite (or bainitic ferrite) and tempered martensite may be the remainder (balance) of the final microstructure. Therefore, the total area ratio of bainite and tempered martensite is preferably 10% to 75%. Therefore, in a case in which strength is required, the total area ratio of bainite and tempered martensite is preferably 15% or more, still more preferably 20% or more, and most preferably 30% or less. In addition, in a case in which ductility is required, the total area ratio of bainite and tempered martensite is more preferably 65% or less, still more preferably 60% or less, and most preferably 50% or less. Among them, since bainite is a microstructure necessary to concentrate C in retained austenite (γ), the microstructure preferably includes 10% or more of bainite. However, when the microstructure includes a large amount of bainite, the amount of ferrite having favorable work-hardening characteristics decreases, and uniform elongation decreases, and therefore the area ratio of bainite is preferably 75% or less. Particularly, in a case in which it is necessary to secure the amount of ferrite, the area ratio of bainite is more preferably 35% or less.

In addition, in a case in which more ductility is secured by tempering martensite that is formed in a manufacturing process, the area ratio of tempered martensite in the microstructure is preferably 35% or less, and more preferably 20% or less. Meanwhile, the lower limit of the area ratio of tempered martensite is 0%.

Thus far, the microstructure of the high-strength cold-rolled steel sheet of the embodiment has been described, but there are cases in which, for example, 0% to 5% of pearlite remains in the microstructure when cementite in the microstructure that will be described below is appropriately controlled.

Furthermore, cementite in the microstructure of the steel sheet of the embodiment will be described.

In order to improve the TRIP effect and suppress the grain growth of ferrite, the average particle size of cementite needs to be 0.01 μm to 1 μm. As described above, the upper limit of the average particle size of cementite is preferably 0.9 μm, more preferably 0.8 μm, and most preferably 0.7 μm. In addition, the lower limit of the average particle size of cementite is preferably 0.02 μm, more preferably 0.03 μm, and most preferably 0.04 μm.

Meanwhile, in order to sufficiently concentrate C in austenite and prevent the above cementite from acting as a starting point of cracking during hole expansion, it is necessary to sufficiently spheroidize the cementite in pearlite. Therefore, the cementite needs to include 30% to 100% of cementite having an aspect ratio (the ratio of the long axis length to the short axis length of the cementite) of 1 to 3. In a case in which more hole expansion are required, the number ratio (spheroidization ratio) of cementite particles having an aspect ratio of 1 to 3 to all the cementite particles is preferably 36% or more, more preferably 42% or more, and most preferably 48% or more. In a case in which it is necessary to reduce the cost for annealing necessary for spheroidization of the cementite or the manufacturing conditions are limited, the present ratio is preferably 90% or less, more preferably 83% or less, and most preferably 80% or less.

Since such spheroidized cementite (undissolved spheroidized cementite) remains in austenite during reverse transformation, and some of them suppress the grain growth of ferrite, the spheroidized cementite is present inside retained austenite grains or in the grain boundaries of ferrite.

Here, for example, there are cases in which cementite which does not directly form from pearlite (film-shaped cementite formed at the interfaces of bainitic ferrite or cementite in bainitic ferrite) causes grain boundary cracking. Therefore, it is desirable to reduce cementite which does not directly form from pearlite as much as possible.

In addition, the amount of cementite spheroidized in the microstructure changes depending on the chemical components and manufacturing conditions, and thus is not particularly limited. However, in order to enhance the pinning effect that suppresses the grain growth of ferrite, 0.003 or more cementite particles having an aspect ratio of 1 to 3 are preferably included per square micrometer. In a case in which the pinning effect needs to be more enhanced, the number of spheroidized cementite particles included per square micrometer is more preferably 0.005 or more, still more preferably 0.007 or more, and most preferably 0.01 or more. In addition, in a case in which it is necessary to further concentrate C in austenite, the number of spheroidized cementite particles included per square micrometer is preferably 0.12 or less, more preferably 0.1 or less, still more preferably 0.08 or less, and most preferably 0.06 or less.

Furthermore, in a case in which high uniform elongation needs to be secured in all directions in the sheet surface without causing in-plane anisotropy, it is desirable to control the crystal orientation distribution (texture) of retained austenite. In this case, austenite is stable with respect to deformation in a crystal orientation <100>, and therefore crystal orientations including <100> are uniformly dispersed in the sheet surface.

With regard to the orientations of crystals, generally, an orientation perpendicular to a sheet surface is represented by (hkl) or {hkl}, and an orientation parallel to a rolling direction is represented by [uvw] or <uvw>. {hkl} and <uvw> are collective terms for equivalent surfaces, and [hkl] and (uvw) indicate individual crystal surfaces. Meanwhile, in the description of crystal orientations, the former expression of {hkl} and <uvw> are used. It is known that, among crystal orientations developing in austenite phases, orientations including a <100> orientation in the sheet surface include a {100} <001> orientation for which the orientation of the sheet surface is {100} and a {110} <111> to {110} <001> orientation group ({110} orientation group) for which the orientation of the sheet surface is {110}. In the case of the {100} <001> orientation, the <001> orientation is aligned to a direction parallel to the rolling direction and a direction parallel to the sheet width direction. Therefore, when retained austenite in the above orientation increases, the stability of austenite with respect to deformation in the rolling direction and the sheet width direction increases, and uniform elongation in the direction increases. However, since uniform elongation, for example, in a direction rotated by 45° toward the sheet width direction from the rolling direction (45° direction) does not improve, when the above orientation alone strongly develops, anisotropy in uniform elongation is exhibited. Meanwhile, in the case of the {110} orientation group, one <100> orientation parallel to the sheet surface is present with respect to each of the orientations included in the orientation group. For example, in the case of the {110} <111> orientation, the <100> orientation faces a direction rotated by 55° toward the sheet width direction from the rolling direction (55° direction). Therefore, when retained austenite in the above orientation increases, uniform elongation in the 55° direction increases.

The above facts show that uniform elongation improves when the intensity ratio of the above orientation or orientation group increases. In order to sufficiently increase uniform elongation, a parameter 2X+Y shown in the following equation (7) is preferably more than 4. When the parameter 2X+Y is 4 or less, orientations are not frequently present as a crystal orientation group, and it is difficult to obtain an effect of sufficiently stabilizing austenite through the control of crystal orientations. From the above viewpoint, the parameter 2X+Y is preferably 5 or more. Meanwhile, when the texture of austenite phases develops, and the intensity ratio thereof excessively increases, there is a tendency in which the intensity ratio of a {110} <111> to {110} <112> orientation group among the {110} <111> to {110} <001> orientation group increases. As a result, only the uniform elongation in a 45° direction improves, and anisotropy is liable to be exhibited.

From the above viewpoint, the parameter 2X+Y in the following equation (7) is preferably less than 10, and more preferably 9 or less.

$$4<2X+Y<10 \quad (7)$$

Here,

X refers to an average value of the random intensity ratios of austenite phases (retained austenite phases) in the {100} <001> orientation at a half-thickness position of a sheet (the central portion), and Y refers to an average value of the random intensity ratios of austenite phases (retained austenite phases) in the {110} <111> to {110} <001> orientation group at a half-thickness position of a sheet (the central portion).

In addition, from the viewpoint of suppressing the exhibition of anisotropy, {110} <111>/{110} <001> which is a ratio of the random intensity ratio of the {110} <111> orientation to the random intensity ratio of the {110} <001> orientation is preferably suppressed to be 3.0 or less, and preferably 2.8 or less. The lower limit of the {110} <111>/{110} <001> is not particularly limited, and may be 0.1.

Each average value of the random intensity ratios of the {100} <001> orientation, the {110} <111> orientation, the {110} <001> orientation and the random intensity ratio of the {110} <111> to {110} <001> orientation group may be obtained from orientation distribution functions (hereinafter referred to as ODF) which indicate 3-dimensional textures. An ODF is computed by the series expansion method based on the {200}, {311}, and {220} pole figures of austenite phase measured through X-ray diffraction. Meanwhile, the random intensity ratio refers to a numeric value obtained by measuring the X-ray intensities of a standard specimen having no accumulation in a specific orientation and a test specimen under the same conditions by the X-ray diffractometry or the like, and dividing the obtained X-ray intensity of the test specimen by the X-ray intensity of the standard specimen.

Figure 4:
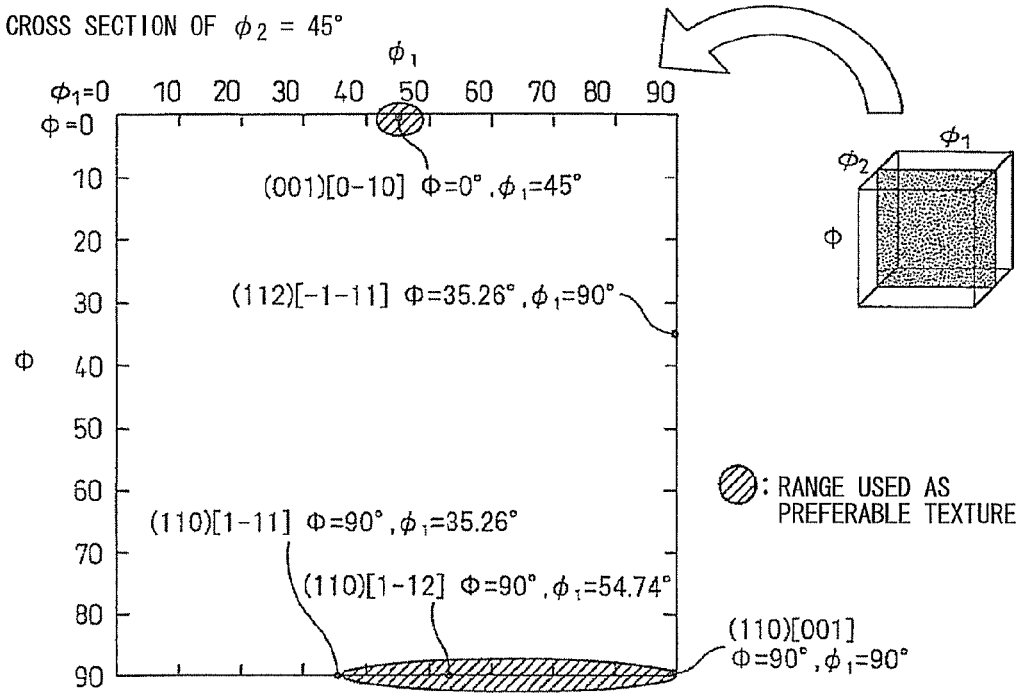
FIG. 4 is a view showing the main orientation of austenite phases on ODF in a cross section for which $\phi_2$ is 45°.

FIG. 4 shows the ODF of a cross section for which $\phi_2$ is 45°. In FIG. 4, the 3-dimensional texture is shown by the Bunge notation using orientation distribution functions. Furthermore, the Euler angle $\phi_2$ is set to 45°, and (hkl) [uvw] which is a specific orientation is expressed using an Euler angle $\phi_1$, $\Phi$ of the orientation distribution functions. For example, as shown by points on the axis with $\Phi$=90° in FIG. 4, the {110} <111> to {110} <001> orientation group is expressed in a range in which $\phi_1$=35° to 90°, $\Phi$=90°, and $\phi_2$=45° are satisfied. Thereby, the average value of the random intensity ratios of the {110} <111> to {110} <001> orientation group can be obtained by averaging the random intensity ratios in a range in which $\phi_1$ is in a range of 35° to 90°.

Meanwhile, as described above, a crystal orientation is generally expressed using (hkl) or {hkl} for an orientation perpendicular to a sheet surface and [uvw] or <uvw> for an orientation parallel to a rolling direction. {hkl} and <uvw> are collective terms for equivalent surfaces, and (hkl) and [uvw] indicate individual crystal surfaces. Here, since the subject is a face-centered cubic structure (hereinafter referred to as the f.c.c. structure), for example, (111), (−111), (1-11), (11-1), (−1-11), (−11-1), (1-1-1), and (−1-1-1) planes are all equivalent, and these planes cannot be differentiated. In such a case, those orientations are collectively termed to be {111}. However, since ODF is also used to express orientations of a crystal structure having a low symmetry, generally, the orientations are expressed in a range of $\phi_1$ of 0° to 360°, $\Phi$ of 0° to 180°, and $\phi_2$ of 0° to 360°, and individual orientations are expressed by (hkl) [uvw]. However, here, since the subject is an f.c.c. structure having a high symmetry, $\Phi$ and $\phi_2$ are expressed in a range of 0° to 90°. In addition, the range of $\phi_1$ changes depending on whether or not symmetry due to deformation is taken into account when computation is carried out, but $\phi_1$ is expressed by 0° to 90° in consideration of symmetry. That is, a method is selected in which the average value of the same orientations having $\phi_1$ of 0° to 360° is expressed on an ODF having $\phi_1$ of 0° to 90°. In this case, (hkl) [uvw] and {hkl} <uvw> have the same meaning. Therefore, for example, the X-ray random intensity ratio (random intensity ratio) of (110) [1-11] of an ODF in a cross section having $\phi_2$ of 45°, which is shown in FIG. 1, is the X-ray random intensity ratio of a {110} <111> orientation.

The specimen for X-ray diffraction is prepared in the following manner. A steel sheet is polished to a predetermined position in the sheet thickness direction through a polishing method, such as mechanical polishing or chemical polishing, the surface of the steel sheet is finished to be a mirror surface through buffing, then, strains are removed through a polishing method, such as electrolytic polishing or chemical polishing, and, at the same time, a half-thickness portion (a central portion of the sheet thickness) is adjusted so as to be a measurement surface. In the case of a cold-rolled sheet, the texture in the sheet thickness (sheet thickness direction) is not considered to change significantly. However, since the vicinity of the sheet thickness surface is liable to be influenced by shearing due to rolling or decarburization, and has a higher possibility of a change in the microstructure of the steel sheet, measurement is carried out at the half-thickness portion. Meanwhile, since it is difficult to carry out measurement at a surface that is exactly the center of the sheet thickness as the half-thickness portion, the specimen may be prepared so that the measurement surface is included in a range of 3% of the sheet thickness from the target position. In a case in which central segregation occurs, the measurement position may be shifted to a portion in which segregation has no influence. In addition, in a case in which measurement by X-ray diffraction is difficult, a statistically sufficient number of measurements may be carried out by an electron back scattering pattern (EBSP) method or an electron channeling pattern (ECP) method.

Figure 5:
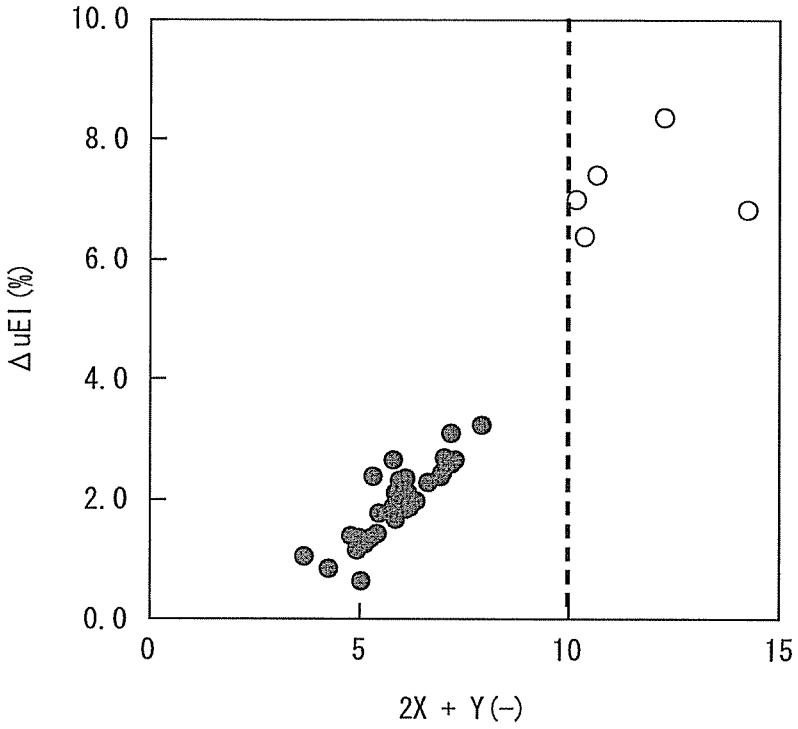
FIG. 5 is a view showing the relationship between a parameter 2X+Y and the anisotropy index ΔuEL of uniform elongation.

It is found that the anisotropy index ΔuEL of uniform elongation is lowered by, for example, controlling the texture (parameter 2X+Y) of a steel sheet as shown in FIG. 5. The anisotropy index ΔuEL of uniform elongation refers to the maximum deviation (difference between the maximum value and the minimum value) of uniform elongation in a case in which tensile tests are carried out on tensile test specimens (JIS No. 5 tensile test specimens) having different sampling directions (the tensile direction in the tensile tests) in the sheet surface.

Figure 6:
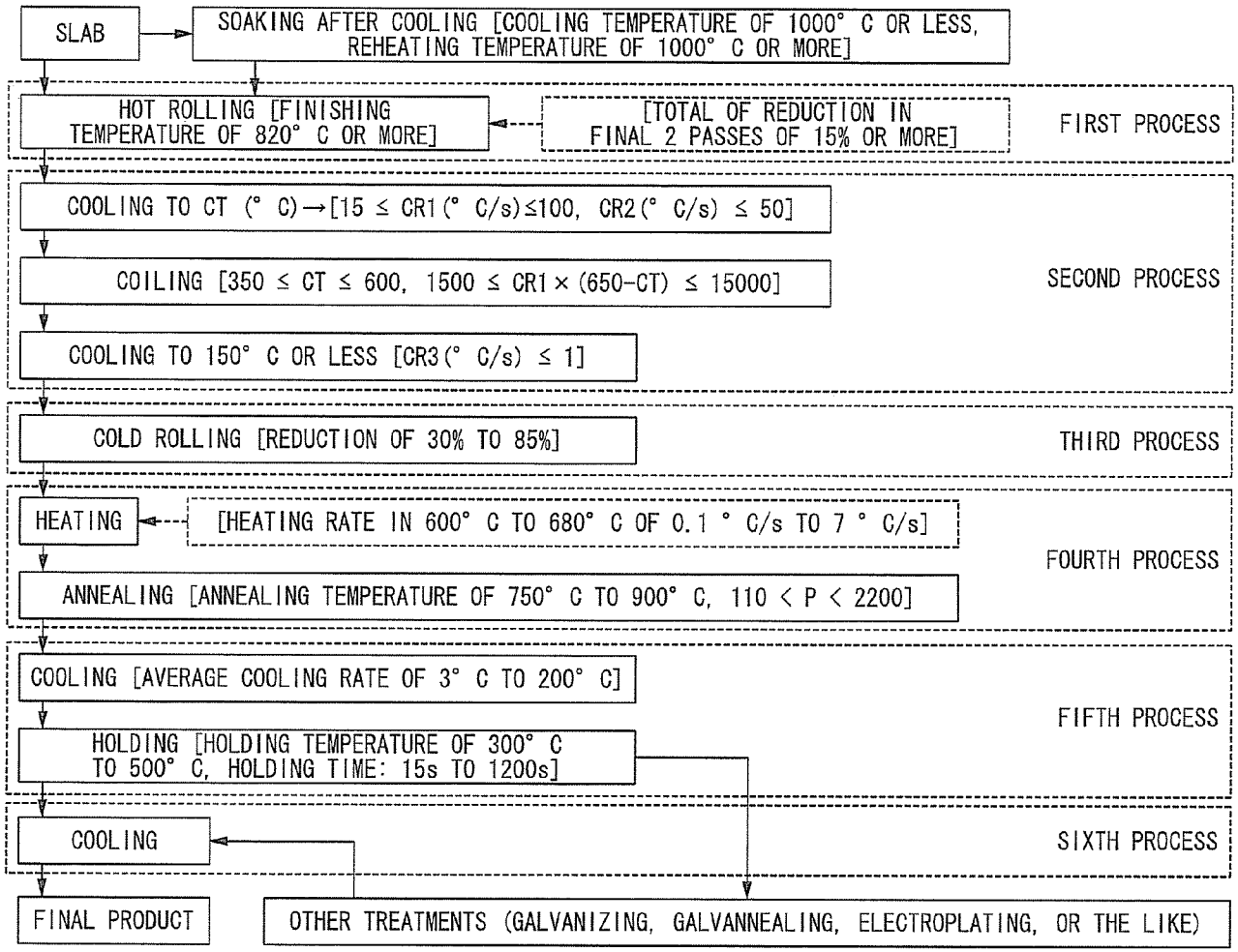
FIG. 6 is a view showing the flowchart of a method of manufacturing a high-strength cold-rolled steel sheet according to an embodiment of the present invention.

Next, an embodiment of a method of manufacturing the high-strength cold-rolled steel sheet of the present invention will be described. FIG. 6 shows a flowchart of the method of manufacturing the high-strength steel sheet of the embodiment. The dashed arrows in the flowchart show preferable optional conditions.

In the embodiment, steel prepared and melted by an ordinary method (molten steel) is cast, an obtained slab is hot-rolled, and pickling, cold rolling, and annealing are carried out on an obtained hot-rolled steel sheet. Hot rolling can be carried out in an ordinary continuous hot rolling line, and annealing after cold rolling can be carried out in a continuous annealing line. In addition, skin pass rolling may be carried out on a cold-rolled steel sheet.

Other than steel melted by an ordinary blast furnace method, steel in which a large amount of scrap is used, such as electric furnace steel, can be used as the molten steel. Slab may be manufactured through an ordinary continuous casting process or thin slab casting.

Meanwhile, after casting, the slab can be hot-rolled as it is. However, before hot rolling, the slab may be, firstly, cooled to 1000° C. or lower (preferably 950° C. or lower), and then reheated to 1000° C. or higher for homogenization. In order to sufficiently homogenize the slab and reliably prevent degradation of the strength, the reheating temperature is preferably 1100° C. or higher. In addition, in order to prevent the grain size of austenite before hot rolling from extremely increasing, the reheating temperature is preferably 1300° C. or lower.

If the finishing temperature of hot rolling is too high when the slab is hot-rolled, the amount of scale formed increases, and the surface quality and corrosion resistance of the product are adversely influenced. In addition, there are cases in which the grain size of austenite coarsens so as to lower the fraction of ferrite phases and degrade ductility. Furthermore, since the grain size of austenite coarsens, the grain sizes of ferrite and pearlite also coarsen. Therefore, the finishing temperature of hot rolling is preferably 1000° C. or lower, and more preferably 970° C. or lower. In addition, in order to prevent formation of deformed ferrite and maintain favorable steel sheet shapes, hot rolling needs to be carried out at a temperature at which the microstructure of an austenite single phase can be maintained, that is, a finishing temperature of 820° C. or higher. Furthermore, in order to reliably avoid rolling in a two-phase region in which ferrite is formed in austenite, hot rolling is preferably carried out at a finishing temperature of 850° C. or higher.

At this time, in order to refine retained austenite in the finally obtained steel sheet, it is effective to refine the microstructure (grain size of austenite) in the steel sheet during hot rolling. Therefore, the total of the reduction in thickness of the last two steps in hot rolling is preferably 15% or more. As such, in a case in which the total of the reduction in thickness of the last two steps is 15% or more, the microstructure (for example, ferrite or pearlite) of the hot-rolled steel sheet can be sufficiently refined, and the microstructure of the steel sheet becomes uniform so that elongation in a temperature range of 100° C. to 250° C. can increase. In a case in which retained austenite needs to be further refined, the total of the reduction in thickness of the last two steps (the last two passes) is more preferably 20% or more. In addition, in order to maintain favorable steel sheet shapes, and reduce loads on mill rolls, the total of the reduction in thickness of the last two steps (the last two passes) may be 60% or less.

In the embodiment, a fine pearlite is secured in the hot-rolled steel sheet by controlling the coiling temperature and the cooling rate (cooling rate after hot rolling) before and after coiling. That is, as shown in the following equations (8) to (11), a first average cooling rate CR1(° C./s) from 750° C. to 650° C. is 15° C./s to 100° C./s, a second average cooling rate CR2(° C./s) from 650° C. to the coiling temperature CT(° C.) is 50° C./s or less, a third average cooling rate CR3(° C./s) from after the coiling to 150° C. is 1° C./s or less, the coiling temperature CT(° C.) and the first average cooling rate CR1(° C./s) satisfy the following equation (11).

$$15 \leq CR1 \quad (8)$$

$$CR2 \leq 50 \quad (9)$$

$$CR3 \leq 1 \quad (10)$$

$$1500 \leq CR1 \times (650 - CT) \leq 15000 \quad (11)$$

Here, in a case in which the first average cooling rate CR1 is less than 15° C./s, a coarse pearlite increases, and coarse cementite remains in the cold-rolled steel sheet. In a case in which it is necessary to further refine the pearlite and further accelerate dissolving of the cementite during annealing, the first average cooling rate CR1 is preferably 30° C./s. However, in a case in which the first average cooling rate CR1 exceeds 100° C./s, it is difficult to control the subsequent cooling rates. As such, it is necessary to maintain the cooling rate (the first average cooling rate CR1) in the front cooling zone at a high level during cooling after hot rolling. In the front cooling zone, the hot-rolled steel sheet is cooled to a temperature between the finishing temperature and the coiling temperature so that the microstructure of the steel sheet becomes uniform sufficiently. In addition, in a case in which the second average cooling rate CR2 exceeds 50° C./s, transformation does not easily proceed, and therefore bainite and fine pearlite are not easily formed in the hot-rolled steel sheet. Similarly, also in a case in which the third average cooling rate CR3 exceeds 1° C./s, transformation does not easily proceed, and therefore bainite and fine pearlite are not easily formed in the hot-rolled steel sheet. In such cases, it is difficult to secure the necessary amount of austenite in the cold-rolled steel sheet. In addition, the lower limits of the second average cooling rate CR2 and the third average cooling rate CR3 are not particularly limited, but is preferably 0.001° C./s or more, more preferably 0.002° C./s or more, still more preferably 0.003° C./s or more, and most preferably 0.004° C./s from the viewpoint of productivity. Additionally, in a case in which CR1×(650−CT) in the equation (11) is less than 1500, the average area of pearlite in the hot-rolled steel sheet increases, and coarse cementite remains in the cold-rolled steel sheet. In a case in which CR1×(650−CT) exceeds 15000, pearlite is not easily formed in the hot-rolled steel sheet, and therefore it is difficult to secure the necessary amount of austenite in the cold-rolled steel sheet.

As such, it is necessary to maintain the cooling rate (the first average cooling rate CR1) in the front cooling zone at a high level during cooling after hot rolling. In the front cooling zone, the hot-rolled steel sheet is cooled to a temperature between the finishing temperature and the coiling temperature so that the microstructure of the steel sheet becomes uniform sufficiently.

Figure 7:
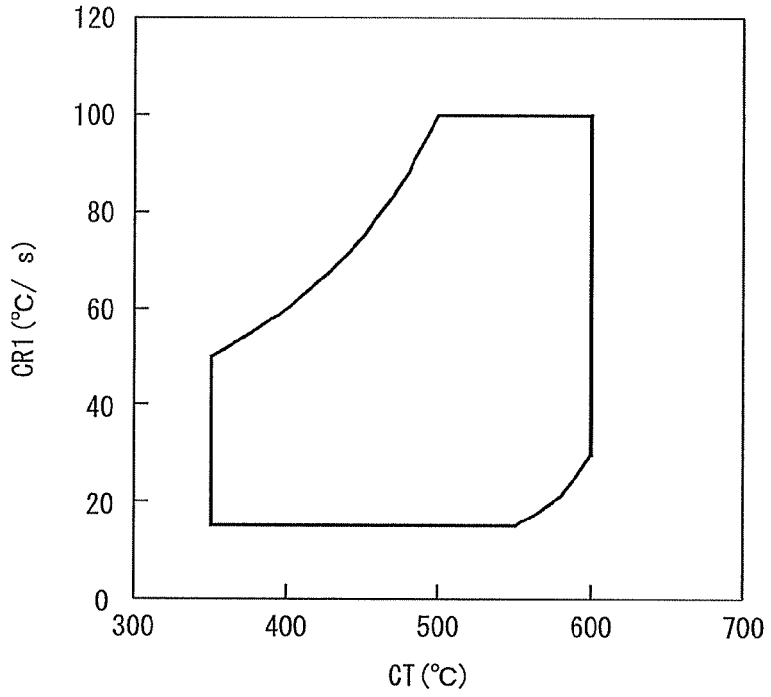
FIG. 7 is a view showing the relationship between the coiling temperature CT and the first average cooling rate CR1in the method of manufacturing the high-strength cold-rolled steel sheet according to the embodiment.

Furthermore, the coiling temperature CT after cooling in the middle cooling zone (cooling at the second average cooling rate CR2) is important. In order to refine the microstructure of the cold-rolled steel sheet, it is necessary to set the coiling temperature CT in a range of 350° C. to 600° C. while satisfying the above equation (11). That is, the coiling temperature CT can be determined in the range as shown in FIG. 7 according to the first cooling rate CR1. Meanwhile, the coiling temperature is an average temperature of the steel sheet during coiling.

Here, when the coiling temperature CT becomes lower than 350° C., the microstructure of the hot-rolled steel sheet mainly includes martensite, and the load of cold rolling increases. On the other hand, when the coiling temperature exceeds 600° C., coarse pearlite increases, the average grain size of ferrite in the cold-rolled steel sheet increases, and the balance between strength and hole expansion becomes low.

In order to further decrease the load of cold rolling, the coiling temperature CT is preferably 360° C. or higher, more preferably 370° C. or higher, and most preferably 380° C. or higher. In addition, in a case in which the microstructure of the cold-rolled steel sheet needs to be further refined, the coiling temperature CT is preferably 580° C. or lower, more preferably 570° C. or lower, and most preferably 560° C. or lower.

As described above, in the embodiment, the hot-rolled steel sheet is cooled at the first average cooling rate CR1 from 750° C. to 650° C., cooled at the second average cooling rate CR2 from 650° C. to the coiling temperature CT, coiled at the coiling temperature CT, and cooled at the third average cooling rate CR3 from after the coiling to 150° C.

During cold rolling, a reduction in thickness of 30% or more is required in order to refine the microstructure after annealing. On the other hand, when the reduction in thickness of cold rolling exceeds 85%, the load of cold rolling increases due to work-hardening, and productivity is impaired. Therefore, the reduction in thickness of cold rolling is in a range of 30% to 85%. Meanwhile, in a case in which the microstructure needs to be further refined, the reduction in thickness is preferably 35% or more, more preferably 40% or more, and most preferably 45% or more. In a case in which it is necessary to further decrease the load of cold rolling or optimize the texture, the reduction in thickness is preferably 75% or less, more preferably 65% or less, and most preferably 60% or less.

After cold rolling, the steel sheet is annealed. In the embodiment, in order to control the microstructure of the steel sheet, the heating temperature of the steel sheet during annealing and the cooling conditions of the steel sheet after annealing are extremely important.

When the steel sheet is heated during annealing, the deformed microstructure formed due to cold rolling is recrystallized, and austenite formers, such as C, are concentrated in austenite. In the embodiment, the heating temperature during annealing is set to a temperature at which ferrite and austenite coexist ($A_{c1}$ point to $A_{c3}$ point).

When the heating temperature during annealing is lower than 750° C., the microstructure is not sufficiently recrystallized, and sufficient ductility cannot be obtained. In order to more reliably improve ductility through recrystallization, the heating temperature during annealing is preferably 755° C. or higher, more preferably 760° C. or higher, and most preferably 765° C. or higher. On the other hand, when the heating temperature during annealing exceeds 900° C., austenite increases, and the austenite formers, such as C, do not sufficiently concentrate. In order to prevent excessive reverse transformation and more effectively concentrate the austenite formers, the heating temperature during annealing is preferably 890° C. or lower, more preferably 880° C. or lower, and most preferably 870° C. or lower. As a result, the stability of austenite is impaired, and it becomes difficult to secure retained austenite after cooling. Therefore, the heating temperature during annealing is 750° C. to 900° C.

The time (heating time) during which the steel sheet heated to an annealing temperature of 750° C. to 900° C. is held in a temperature range of 750° C. to 900° C. needs to satisfy the above equation (4) in order to sufficiently dissolve cementite so as to secure the amount of C in austenite. Meanwhile, in the equation (4), T (° C.) refers to the average heating temperature during annealing, and t (s) refers to the heating time during annealing. Here, the average heating temperature T (° C.) during annealing is the average temperature of the steel sheet while the steel sheet is heated and held in a temperature range of 750° C. to 900° C. In addition, the heating time t(s) during annealing is the time during which the steel sheet is heated and held in a temperature range of 750° C. to 900° C.

That is, during annealing, the annealing parameter P needs to be more than 110 to less than 2200. As described above, the annealing parameter P is preferably more than 130, more preferably more than 140, and most preferably more than 150. In addition, the annealing parameter P is preferably less than 2100, more preferably less than 2000, and most preferably less than 1900.

Meanwhile, in a case in which it is necessary to secure high uniform elongation in any direction in the sheet surface without causing in-plane anisotropy, it is desirable to control the heating during annealing in addition to the coiling temperature CT, the reduction in thickness of the cold rolling, and the annealing conditions. That is, the average heating rate is preferably controlled to become 0.1° C./s to 7° C./s in a range of 600° C. to 680° C. in heating during annealing. Recrystallization is significantly accelerated by decreasing the heating rate in the temperature range and increasing the holding time. As a result, the texture of retained austenite improves. However, in an ordinary facility, it is extremely difficult to control the heating rate to be extremely slow, and special effects cannot be expected. Therefore, from the viewpoint of productivity, the average heating rate is more preferably 0.3° C./s or more. When the average heating rate is large, anisotropy is liable to be caused in the texture of retained austenite while recrystallization of ferrite is not sufficiently completed. Therefore, the average heating rate is more preferably 5° C./s or less, still more preferably 3° C./s or less, and most preferably 2.5° C./s or less.

The steel sheet that is annealed at an annealing temperature of 750° C. to 900° C. is cooled to a temperature range of 300° C. to 500° C. at an average cooling rate in a range of 3° C./s to 200° C./s. When the average cooling rate is less than 3° C./s, pearlite is formed in the cold-rolled steel sheet. On the other hand, when the average cooling rate exceeds 200° C./s, it becomes difficult to control the cooling stop temperature. In order to freeze the microstructure and effectively proceed with bainite transformation, the average cooling rate is preferably 4° C./s or more, more preferably 5° C./s or more, and most preferably 7° C./s or more. In addition, in order to more appropriately control the cooling stop temperature so as to more reliably prevent precipitation of cementite, the average cooling rate is preferably 100° C./s or less, more preferably 80° C./s or less, and most preferably 60° C./s or less.

Cooling of the steel sheet is stopped, and the steel sheet is held in a temperature range of 300° C. to 500° C. for 15 seconds to 1200 seconds, and then furthermore cooled. Holding the steel sheet in a temperature range of 300° C. to 500° C. forms bainite, prevents precipitation of cementite, and suppresses a decrease in the amount of solute C in retained austenite. When bainite transformation is accelerated as described above, the area ratio of retained austenite can be secured.

When the holding temperature exceeds 500° C., pearlite is formed. On the other hand, when the holding temperature is lower than 300° C., there are cases in which martensite transformation occurs, and bainite transformation does not proceed sufficiently. In addition, when the holding time is less than 15 seconds, bainite transformation does not proceed sufficiently, and it becomes difficult to secure retained austenite. On the other hand, when the holding time exceeds 1200 seconds, productivity degrades, cementite is precipitated, and ductility degrades.

In order to cause more appropriate bainite transformation, the holding temperature is preferably 330° C. or higher, more preferably 350° C. or higher, and most preferably 370° C. or higher. In addition, in order to more reliably prevent formation of pearlite, the holding temperature is preferably 480° C. or lower, more preferably 460° C. or lower, and most preferably 440° C. or lower.

Similarly, in order to cause more appropriate bainite transformation, the holding time is preferably 30 seconds or more, more preferably 40 seconds or more, and most preferably 60 seconds or more. In addition, in order to prevent precipitation of cementite as much as possible, the holding time is preferably 1000 seconds or less, more preferably 900 seconds or less, and most preferably 800 seconds or less.

The method of manufacturing the high-strength cold-rolled steel sheet of the embodiment can be also applied to a coated steel sheet. For example, in a case in which the method is applied to a galvanized steel sheet, the steel sheet that has been held at 300° C. to 500° C. is dipped in a hot-dip galvanizing bath. The temperature of the hot-dip galvanizing bath is frequently 450° C. to 475° C. from the viewpoint of productivity. In addition, for example, in a case in which the method is applied to a galvannealed steel sheet, it is also possible to anneal a steel sheet that has been dipped in a hot-dip galvanizing bath for alloying. However, in a case in which the alloying temperature is not appropriate, there are cases in which corrosion resistance degrades due to insufficient alloying or excessive alloying. Therefore, in order to carry out appropriate alloying while maintaining the microstructure of a base steel, an alloying of a coating is preferably carried out in a range of 400° C. to 600° C. In order to more sufficiently carry out alloying, the alloying temperature is more preferably 480° C. or higher, still more preferably 500° C. or higher, and most preferably 520° C. or higher. In addition, in order to secure coating adhesion while more reliably maintaining the microstructure of a base steel, the alloying temperature is more preferably 580° C. or lower, still more preferably 570° C. or lower, and most preferably 560° C. or lower.

EXAMPLES

The present invention will be described based on examples, but the conditions in the examples are simply an example of the conditions employed to confirm the feasibility and effects of the present invention, and the present invention is not limited to the example of the conditions. The present invention can employ a variety of conditions within the scope of the purport of the present invention as long as the object of the invention can be achieved.

Steels A to V (the chemical components of Examples) and steel a to g (the chemical components of Comparative Examples) having the chemical compositions shown in Table 1 were melted and prepared, steel sheets obtained after cooling and solidification were reheated to 1200° C., and processed under conditions shown in Tables 2 to 5 (hot rolling, cold rolling, annealing, and the like), thereby manufacturing steel sheets A1 to V1 and a1 to g1. 0.5% skin pass rolling was carried out on each of the annealed steel sheets for the purpose of suppressing yield point elongation.

TABLE 1

| Steel | C | Si | Mn | P | S | N | Al | Cr | Mo | Ni | W | V | Cu | Others |
|---|---|---|---|---|---|---|---|---|---|---|---|---|---|---|
| | mass % | | | | | | | | | | | | | |
| A | 0.16 | 2.3 | 2.7 | 0.006 | 0.002 | 0.002 | 0.04 | — | — | 0.5 | — | — | 0.5 | — |
| B | 0.18 | 1.2 | 1.7 | 0.007 | 0.003 | 0.002 | 0.03 | — | — | — | — | — | — | Ca: 0.003 |
| C | 0.11 | 1.2 | 1.5 | 0.006 | 0.001 | 0.002 | 0.034 | — | — | — | — | — | — | REM: 0.005 |
| D | 0.22 | 1.2 | 2.2 | 0.007 | 0.002 | 0.003 | 0.05 | — | — | — | — | — | — | — |
| E | 0.19 | 1.3 | 1.8 | 0.007 | 0.003 | 0.002 | 0.04 | — | — | — | — | — | — | — |
| F | 0.3 | 1.3 | 1.9 | 0.006 | 0.001 | 0.002 | 0.05 | — | — | — | — | — | — | — |
| G | 0.12 | 1.3 | 1.6 | 0.008 | 0.001 | 0.002 | 0.05 | — | — | — | — | — | — | — |
| H | 0.18 | 1.8 | 2.5 | 0.007 | 0.003 | 0.003 | 0.04 | — | — | — | — | — | — | — |
| I | 0.22 | 1.8 | 2.5 | 0.007 | 0.003 | 0.003 | 0.03 | — | — | — | — | — | — | — |
| J | 0.38 | 1.5 | 2.1 | 0.006 | 0.002 | 0.002 | 0.04 | — | — | — | 0.6 | 0.2 | — | — |
| K | 0.25 | 1.5 | 2.9 | 0.008 | 0.003 | 0.005 | 0.01 | — | — | — | — | — | — | Nb: 0.05, Mg: 0.004 |
| L | 0.15 | 0.06 | 1.5 | 0.006 | 0.002 | 0.003 | 0.6 | — | 0.12 | — | — | — | — | — |
| M | 0.18 | 0.1 | 2.5 | 0.007 | 0.003 | 0.002 | 0.1 | — | — | — | — | — | — | Ca: 0.003 |
| N | 0.2 | 0.4 | 2.4 | 0.006 | 0.001 | 0.003 | 0.03 | — | — | — | — | — | — | REM: 0.005 |
| O | 0.22 | 0.5 | 2 | 0.007 | 0.002 | 0.002 | 2.3 | — | — | — | — | — | — | B: 0.005 |
| P | 0.22 | 0.15 | 1.3 | 0.007 | 0.003 | 0.002 | 1 | — | 0.145 | — | — | — | — | Ti: 0.02, Nb: 0.02 |
| Q | 0.25 | 0.5 | 1.9 | 0.006 | 0.002 | 0.002 | 0.9 | — | 0.14 | — | — | — | — | — |
| R | 0.3 | 0.4 | 1.2 | 0.008 | 0.003 | 0.002 | 0.03 | — | — | — | — | — | — | Ti: 0.07 |
| S | 0.3 | 0.07 | 1.6 | 0.006 | 0.001 | 0.003 | 1.4 | — | 0.25 | — | — | — | — | — |
| T | 0.25 | 0.5 | 1.7 | 0.007 | 0.001 | 0.004 | 1.4 | — | 0.15 | — | — | — | — | — |
| U | 0.22 | 0.09 | 0.7 | 0.006 | 0.002 | 0.002 | 1.1 | 0.3 | 0.1 | — | — | 0.2 | — | — |
| V | 0.22 | 0.1 | 1.4 | 0.04 | 0.018 | 0.003 | 1.1 | — | 0.2 | — | — | — | — | Zr: 0.005 |
| a | 0.42 | 1.55 | 2 | 0.006 | 0.001 | 0.002 | 0.03 | — | — | — | — | — | — | — |
| b | 0.05 | 1.2 | 2 | 0.007 | 0.001 | 0.003 | 0.035 | — | — | — | — | — | — | — |
| c | 0.22 | 1.2 | 1.25 | 0.06 | 0.04 | 0.003 | 0.04 | — | 0.2 | — | — | — | — | — |
| d | 0.25 | 3 | 1 | 0.006 | 0.001 | 0.0025 | 0.04 | — | 0.22 | — | — | — | — | — |
| e | 0.25 | 1.15 | 6 | 0.007 | 0.001 | 0.004 | 0.035 | — | — | — | — | — | — | — |
| f | 0.3 | 0.001 | 1.4 | 0.008 | 0.001 | 0.004 | 0.001 | — | — | — | — | — | — | — |
| g | 0.3 | 0.09 | 1.2 | 0.008 | 0.003 | 0.002 | 3 | — | 0.4 | — | — | — | — | — |

The cells having an underline do not satisfy the conditions according to the present invention.

TABLE 2

| Steel sheet | Steel | Hot rolling: Reduction in thickness of last two steps % | Hot rolling: Finishing temperature ° C. | Cooling and coiling: CR1 ° C./s | CR2 ° C./s | CT ° C. | CR1 × (650-CT) ° C.²/s | CR3 ° C./s | S μm² |
|---|---|---|---|---|---|---|---|---|---|
| A1 | A | 18 | 881 | 60 | 29 | 550 | 6000 | 0.01 | 15 |
| A2 | A | 20 | 885 | 40 | 33 | 550 | 4000 | 0.008 | 17 |
| A3 | A | 10 | 885 | 50 | 31 | 550 | 5000 | 0.008 | 29 |
| B1 | B | 20 | 890 | 60 | 28 | 550 | 6000 | 0.008 | 12 |
| B2 | B | 20 | 890 | 60 | 32 | 540 | 6600 | 0.008 | 11 |
| B3 | B | 22 | 895 | 50 | 30 | 480 | 8500 | 0.006 | 5 |
| C1 | C | 19 | 894 | 40 | 34 | 550 | 4000 | 0.01 | 19 |
| C2 | C | 18 | 897 | 50 | 40 | 580 | 3500 | 0.006 | 20 |
| D1 | D | 16 | 888 | 40 | 36 | 540 | 4400 | 0.01 | 22 |
| D2 | D | 16 | 880 | 60 | 33 | 480 | 10200 | 0.006 | 11 |
| D3 | D | 20 | 888 | 60 | 36 | 530 | 7200 | 0.009 | 10 |
| E1 | E | 22 | 887 | 40 | 32 | 550 | 4000 | 0.008 | 14 |
| E2 | E | 19 | 890 | 60 | 40 | 550 | 6000 | 0.01 | 14 |
| F1 | F | 18 | 880 | 40 | 29 | 550 | 4000 | 0.01 | 20 |
| F2 | F | 15 | 895 | 50 | 25 | 550 | 5000 | 0.01 | 22 |
| F3 | F | 20 | 885 | 60 | 39 | 450 | 12000 | 0.009 | 2 |
| F4 | F | 22 | 880 | 60 | 29 | 420 | 13800 | 0.008 | 11 |
| G1 | G | 19 | 901 | 50 | 33 | 550 | 5000 | 0.008 | 16 |
| G2 | G | 18 | 900 | 40 | 36 | 520 | 5200 | 0.008 | 17 |
| H1 | H | 22 | 910 | 50 | 27 | 480 | 8500 | 0.01 | 5 |
| H2 | H | 19 | 900 | 30 | 33 | 520 | 3900 | 0.007 | 19 |
| H3 | H | 18 | 900 | 60 | 35 | 520 | 7800 | 0.006 | 12 |
| H4 | H | 22 | 890 | 10 | 27 | 550 | 1000 | 0.007 | 29 |
| I1 | I | 19 | 912 | 60 | 36 | 550 | 6000 | 0.008 | 14 |
| I2 | I | 18 | 890 | 40 | 32 | 520 | 5200 | 0.006 | 17 |
| J1 | J | 16 | 860 | 50 | 40 | 480 | 8500 | 0.007 | 14 |
| J2 | J | 16 | 892 | 40 | 31 | 650 | 0 | 0.007 | 30 |
| K1 | K | 20 | 845 | 60 | 40 | 540 | 6600 | 0.008 | 11 |

The cells having an underline do not satisfy the conditions according to the present invention.

TABLE 3

| Steel sheet | Steel | Hot rolling: Reduction in thickness of last two steps % | Hot rolling: Finishing temperature ° C. | Cooling and coiling: CR1 ° C./s | CR2 ° C./s | CT ° C. | CR1 × (650-CT) ° C.²/s | CR3 ° C./s | S μm² |
|---|---|---|---|---|---|---|---|---|---|
| L1 | L | 22 | 891 | 50 | 40 | 550 | 5000 | 0.008 | 11 |
| L2 | L | 19 | 900 | 40 | 29 | 560 | 3600 | 0.01 | 19 |
| M1 | M | 18 | 836 | 50 | 27 | 560 | 4500 | 0.008 | 18 |
| M2 | M | 16 | 860 | 30 | 36 | 700 | −1500 | 0.008 | 36 |
| N1 | N | 16 | 849 | 60 | 27 | 550 | 6000 | 0.009 | 18 |
| N2 | N | 20 | 840 | 60 | 40 | 550 | 6000 | 0.006 | 12 |
| O1 | O | 22 | 935 | 40 | 32 | 580 | 2800 | 0.007 | 16 |
| O2 | O | 22 | 910 | 50 | 40 | 540 | 5500 | 0.006 | 11 |
| P1 | P | 19 | 906 | 60 | 32 | 480 | 10200 | 0.007 | 7 |
| P2 | P | 18 | 900 | 60 | 30 | 550 | 6000 | 0.009 | 15 |
| Q1 | Q | 16 | 878 | 50 | 32 | 580 | 3500 | 0.008 | 23 |
| Q2 | Q | 16 | 885 | 40 | 25 | 540 | 4400 | 0.009 | 22 |
| R1 | R | 20 | 864 | 50 | 39 | 480 | 8500 | 0.009 | 8 |
| R2 | R | 22 | 875 | 10 | 32 | 550 | 1000 | 0.007 | 29 |
| S1 | S | 18 | 888 | 40 | 36 | 550 | 4000 | 0.009 | 20 |
| S2 | S | 22 | 895 | 50 | 32 | 550 | 5000 | 0.009 | 11 |
| T1 | T | 19 | 908 | 60 | 31 | 580 | 4200 | 0.01 | 16 |
| T2 | T | 18 | 895 | 60 | 26 | 540 | 6600 | 0.008 | 14 |
| U1 | U | 16 | 918 | 50 | 34 | 480 | 8500 | 0.008 | 14 |
| V1 | V | 16 | 903 | 40 | 28 | 530 | 4800 | 0.007 | 21 |
| a1 | a | 18 | 858 | 50 | 28 | 550 | 5000 | 0.008 | 17 |
| b1 | b | 18 | 901 | 50 | 26 | 550 | 5000 | 0.007 | 17 |
| c1 | c | 18 | 905 | 50 | 32 | 550 | 5000 | 0.006 | 17 |
| d1 | d | 18 | 901 | 50 | 33 | 550 | 5000 | 0.01 | 17 |
| e1 | e | 18 | 879 | 50 | 37 | 550 | 5000 | 0.01 | 17 |
| f1 | f | 18 | 890 | 50 | 31 | 550 | 5000 | 0.008 | 17 |
| g1 | g | 18 | 893 | 50 | 36 | 550 | 5000 | 0.009 | 17 |

The cells having an underline do not satisfy the conditions according to the present invention.

TABLE 4

| | Cold rolling | Heating and annealing | | | Cooling and holding | | | | Alloying |
|---|---|---|---|---|---|---|---|---|---|
| Steel sheet | Reduction in thickness % | Heating rate ° C./s | Annealing temperature ° C. | Annealing time s | Cooling rate ° C./s | Holding temperature ° C. | Holding time s | P — | Alloying temperature ° C. |
| A1 | 50 | 0.5 | 800 | 86 | 40 | 400 | 400 | 167 | No coating |
| A2 | 45 | 0.5 | 780 | 90 | 150 | 400 | 300 | 154 | No coating |
| A3 | 45 | 2.2 | 780 | 30 | 150 | 400 | 100 | 70 | No coating |
| B1 | 60 | 1.9 | 840 | 85 | 40 | 400 | 300 | 218 | 440 |
| B2 | 50 | 1.6 | 850 | 90 | 4 | 450 | 40 | 236 | 440 |
| B3 | 45 | 2 | 980 | 70 | 40 | 380 | 40 | 474 | 410 |
| C1 | 55 | 0.6 | 800 | 60 | 40 | 425 | 300 | 133 | 460 |
| C2 | 60 | 1.2 | 850 | 90 | 4 | 450 | 40 | 145 | 460 |
| D1 | 50 | 1.6 | 775 | 90 | 50 | 400 | 300 | 119 | No coating |
| D2 | 45 | 2.4 | 820 | 80 | 100 | 425 | 300 | 217 | No coating |
| D3 | 50 | 2.2 | 660 | 80 | 100 | 380 | 300 | 189 | No coating |
| E1 | 45 | 2 | 800 | 90 | 40 | 425 | 300 | 187 | No coating |
| E2 | 55 | 1.8 | 800 | 80 | 100 | 425 | 300 | 194 | No coating |
| F1 | 60 | 1.7 | 775 | 85 | 50 | 400 | 200 | 134 | No coating |
| F2 | 55 | 1.8 | 840 | 70 | 100 | 425 | 300 | 117 | No coating |
| F3 | 60 | 30 | 820 | 70 | 100 | 220 | 300 | 598 | No coating |
| F4 | 50 | 0.5 | 800 | 65 | 100 | 550 | 300 | 198 | No coating |
| G1 | 45 | 1.4 | 800 | 90 | 40 | 425 | 300 | 172 | No coating |
| G2 | 50 | 1.4 | 800 | 80 | 100 | 400 | 300 | 146 | No coating |
| H1 | 45 | 2.3 | 775 | 90 | 50 | 400 | 150 | 357 | No coating |
| H2 | 55 | 2 | 840 | 90 | 100 | 425 | 200 | 144 | No coating |
| H3 | 90 | 1.8 | 820 | 80 | 120 | 400 | 1400 | 200 | No coating |
| H4 | 55 | 0.6 | 800 | 80 | 120 | 425 | 200 | 94 | No coating |
| I1 | 60 | 1.7 | 775 | 90 | 50 | 400 | 300 | 186 | No coating |
| I2 | 70 | 1.9 | 780 | 80 | 100 | 380 | 200 | 147 | No coating |
| J1 | 45 | 2.2 | 800 | 80 | 40 | 380 | 300 | 173 | No coating |
| J2 | 50 | 2.2 | 800 | 90 | 40 | 425 | 300 | 95 | No coating |
| K1 | 45 | 1 | 780 | 90 | 40 | 400 | 400 | 230 | No coating |

The cells having an underline do not satisfy the conditions according to the present invention.

TABLE 5

| | Cold rolling | Heating and annealing | | | Cooling and holding | | | | Alloying |
|---|---|---|---|---|---|---|---|---|---|
| Steel sheet | Reduction in thickness % | Heating rate ° C./s | Annealing temperature ° C. | Annealing time s | Cooling rate ° C./s | Holding temperature ° C. | Holding time s | P — | Alloying temperature ° C. |
| L1 | 55 | 2.1 | 850 | 90 | 4 | 440 | 40 | 202 | 470 |
| L2 | 60 | 1.2 | 775 | 90 | 40 | 440 | 400 | 156 | 470 |
| M1 | 50 | 0.8 | 800 | 90 | 4 | 425 | 40 | 171 | 500 |
| M2 | 45 | 1.8 | 800 | 90 | 40 | 380 | 300 | 87 | 500 |
| N1 | 50 | 0.7 | 840 | 90 | 4 | 425 | 40 | 182 | 500 |
| N2 | 45 | 1.1 | 820 | 90 | 40 | 450 | 300 | 265 | 500 |
| O1 | 55 | 2.2 | 800 | 90 | 4 | 400 | 40 | 190 | 500 |
| O2 | 50 | 0.7 | 800 | 90 | 40 | 425 | 300 | 296 | 500 |
| P1 | 45 | 1.1 | 800 | 90 | 4 | 430 | 40 | 450 | 520 |
| P2 | 50 | 2 | 800 | 90 | 40 | 430 | 400 | 207 | 520 |
| Q1 | 45 | 1.8 | 800 | 90 | 4 | 425 | 40 | 137 | 520 |
| Q2 | 55 | 1 | 775 | 90 | 50 | 430 | 350 | 136 | 520 |
| R1 | 60 | 1.6 | 800 | 90 | 4 | 400 | 40 | 401 | 500 |
| R2 | 50 | 1.8 | 820 | 90 | 40 | 425 | 300 | 109 | 500 |
| S1 | 45 | 0.7 | 840 | 90 | 4 | 380 | 40 | 163 | 500 |
| S2 | 50 | 1.2 | 840 | 90 | 40 | 380 | 300 | 287 | 500 |
| T1 | 45 | 0.7 | 780 | 90 | 4 | 425 | 40 | 191 | 520 |
| T2 | 55 | 1.3 | 775 | 90 | 40 | 440 | 350 | 213 | 520 |
| U1 | 60 | 1.9 | 780 | 90 | 4 | 425 | 40 | 221 | 520 |
| V1 | 55 | 0.8 | 830 | 90 | 4 | 380 | 40 | 152 | 520 |
| a1 | 50 | 1.5 | 800 | 90 | 40 | 400 | 300 | 179 | No coating |
| b1 | 50 | 1 | 800 | 90 | 40 | 400 | 300 | 179 | No coating |
| c1 | 50 | 1.7 | 800 | 90 | 4 | 400 | 300 | 179 | 500 |
| d1 | 50 | 1.1 | 800 | 90 | 40 | 400 | 300 | 179 | 500 |
| e1 | 50 | 0.6 | 800 | 90 | 4 | 400 | 40 | 179 | No coating |
| f1 | 50 | 1.4 | 800 | 90 | 40 | 400 | 300 | 179 | No coating |
| g1 | 50 | 1.1 | 800 | 90 | 40 | 400 | 300 | 179 | 500 |

The cells having an underline do not satisfy the conditions according to the present invention.

The steel sheets manufactured in the above manner were evaluated as follows. A JIS No. 5 tensile test specimen in a C direction (a direction perpendicular to a rolling direction) was prepared, a tensile test was carried out at 25° C., and tensile strength TS, total elongation tEL, and uniform elongation uEL were evaluated. Similarly, a JIS No. 5 test specimen in the C direction was immersed in an oil bath of 150° C., a tensile test was carried out, and elongation (total elongation) at 150° C. $tEL_{150}$ was evaluated. Here, the elongation at 150° C. was evaluated as an elongation in a warm range. Furthermore, with regard to each of the thin steel sheets, a characteristic index E obtained from the following equation (12) was computed from the tensile strength TS and the elongation at 150° C. $tEL_{150}$.

$$E=tEL_{150}+0.027TS-56.5 \quad (12)$$

Meanwhile, the equation (12) will be described below.

Furthermore, hole expansion λ, were evaluated through hole expansion tests.

In addition, a cross section of the steel sheet in the rolling direction or a cross section perpendicular to the rolling direction was observed using an optical microscope at a magnification of 500 times to 1000 times, and the obtained image was evaluated using an image analyzer. The average area S of pearlite in the hot-rolled steel sheet and the microstructure in the cold-rolled steel sheet (the area ratio and average grain size of ferrite, the area ratio of bainite, the average grain size of retained austenite, the area ratio of martensite, and the area ratio of tempered martensite) were quantified.

Meanwhile, in a case in which ferrite, bainite, pearlite, and retained austenite were evaluated, the cross section of the measurement specimen was etched using a Nital reagent. In a case in which martensite was evaluated, the cross section of the measurement specimen was etched using a LePera reagent. In a case in which cementite was evaluated, the cross section of the measurement specimen was etched using a picral reagent.

Here, the average grain sizes of ferrite and retained austenite are evaluated by, for example, observing arbitrary areas on the cross section of the steel sheet using an optical microscope, measuring the number of the grains (ferrite grains or austenite grains) in a range of 1000 $\mu m^2$ or more, and obtaining the average equivalent circle diameter.

In addition, in order to obtain the average grain size, aspect ratio, and number per unit area of cementite particles in the cold-rolled steel sheet, a replica sample was prepared, and an image was obtained using a transmission emission microscope (TEM). The area of 20 to 50 cementite particles in the image was obtained, converted to an area of one cementite particle, and the average particle size of the cementite was evaluated using an average equivalent circle diameter. Furthermore, the short axis length and long axis length of the cementite were measured so as to obtain an aspect ratio, and the above spheroidization ratio was computed. Similarly, the number of cementite particles having an aspect ratio of 1 to 3 was divided by the evaluation area, thereby computing the number of the cementite particles per unit area (density). Meanwhile, for observation of the cementite, for example, an optical microscope and a scanning electron microscope (SEM) can be appropriately used depending on the particle size distribution of the cementite.

As shown below, the area ratio of retained austenite was obtained by the X-ray diffractometry disclosed in Japanese Unexamined Patent Application, First Publication No. 2004-269947.

A surface at a depth of 7/16 of the sheet thickness from the base steel surface (the steel sheet surface or the interface between the coating and the steel sheet) was chemically polished, and then the diffraction intensity Iα (200) in (200) of ferrite, the diffraction intensity Iα (211) in (211) of ferrite, the diffraction intensity Iγ (220) in (220) of austenite, and the diffraction intensity Iγ (311) in (311) of austenite were measured through X-ray diffraction using a Mo tube (MoKα). The area ratio Vγ (%) of retained austenite was obtained from the diffraction intensity (integrated intensity) using the following equation (13).

$$V\gamma=0.25\times\{I\gamma(220)/(1.35\times I\alpha(200)+I\gamma(220))+I\gamma(220)/(0.69\times I\alpha(211)+I\gamma(220))+I\gamma(311)/(1.5\times I\alpha(200)+I\gamma(311))+I\gamma(311)/(0.69\times I\alpha(211)+I\gamma(311))\} \quad (13)$$

In addition, for retained austenite phases in the half-thickness portion of the steel sheet, each average value of the random intensity ratios of a {100} <001> orientation, a {110} <111> orientation, a {110} <001> orientation, and a {110} <111> to {110} <011> orientation group was measured in the following manner. Firstly, the steel sheet was mechanically polished, buffed, then, furthermore, electrolytic-polished so as to remove strains, and X-ray diffraction was carried out using a specimen that was adjusted so that the half-thickness portion became the measurement surface. Meanwhile, X-ray diffraction of a standard specimen having no accumulation in a specific orientation was also carried out under the same conditions as for the measurement specimen. Next, orientation distribution functions (ODF) were obtained by a series expansion method based on the pole figures of {200}, {311}, and {220} of austenite phases which were obtained through X-ray diffraction. Each average value of the random intensity ratios of the {100} <001> orientation, the {110} <112> orientation, the {110} <001> orientation, and the {110} <112> to {110} <001> orientation group was obtained from the ODF. 2X+Y in the above equation (7) and {110} <111>/{110} <001> were computed from the average values of the random intensity ratios.

The results are shown in Tables 6 to 9. In Tables 6 to 9, ferrite, retained austenite, bainite, martensite, tempered martensite, and cementite are abbreviated to F, γ, B, M, M', and θ, respectively.

TABLE 6

| Steel sheet | Area ratio of F + B % | Area ratio of γ % | Area ratio of M % | Area ratio of F % | Area ratio of B + M' % | Area ratio of P % | Grain size of F μm | Grain size of γ μm | Particle size of θ μm | Spheroidized ratio % | Density of θ particles/μm |
|---|---|---|---|---|---|---|---|---|---|---|---|
| A1 | 60 | 17 | 9 | 50 | 10 | 0 | 5.8 | 2.4 | 0.3 | 73.9 | 0.051 |
| A2 | 60 | 17 | 8 | 40 | 20 | 0 | 4.8 | 2.5 | 0.3 | 79.3 | 0.045 |
| A3 | 55 | 18 | 10 | 38 | 17 | 0 | 15.2 | 8.0 | 1.2 | 20.0 | 0.170 |
| B1 | 62 | 11 | 3 | 40 | 22 | 0 | 3.9 | 2.5 | 0.2 | 79.3 | 0.050 |
| B2 | 62 | 11 | 6 | 30 | 32 | 3 | 5.0 | 3.5 | 0.2 | 57.7 | 0.057 |
| B3 | 25 | 1 | 23 | 0 | 54 | 0 | 6.5 | 4.1 | 0.1 | 3.0 | 0.200 |
| C1 | 67 | 10 | 4 | 40 | 27 | 0 | 2.9 | 2.4 | 0.3 | 84.2 | 0.031 |
| C2 | 66 | 10 | 2 | 17 | 49 | 2 | 5.0 | 3.5 | 0.3 | 57.7 | 0.033 |
| D1 | 53 | 14 | 11 | 40 | 13 | 0 | 3.8 | 2.5 | 0.4 | 79.3 | 0.042 |

TABLE 6-continued

| Steel sheet | Area ratio of F + B % | Area ratio of γ % | Area ratio of M % | Area ratio of F % | Area ratio of B + M' % | Area ratio of P % | Grain size of F μm | Grain size of γ μm | Particle size of θ μm | Spheroidized ratio % | Density of θ particles/μm |
|---|---|---|---|---|---|---|---|---|---|---|---|
| D2 | 53 | 14 | 5 | 35 | 18 | 0 | 5.4 | 2.4 | 0.3 | 84.2 | 0.050 |
| D3 | 100 | 0 | 0 | 100 | 25 | 0 | 8.3 | — | 1.0 | 90.0 | 0.700 |
| E1 | 60 | 12 | 3 | 40 | 20 | 0 | 4.1 | 2.4 | 0.3 | 84.2 | 0.058 |
| E2 | 61 | 12 | 3 | 40 | 21 | 0 | 7.4 | 2.4 | 0.3 | 84.2 | 0.058 |
| F1 | 65 | 19 | 5 | 55 | 10 | 0 | 7.2 | 2.7 | 0.5 | 73.6 | 0.052 |
| F2 | 54 | 18 | 5 | 27 | 27 | 0 | 6.8 | 2.4 | 0.5 | 84.2 | 0.049 |
| F3 | 54 | 1 | 5 | 40 | 34 | 0 | 9.4 | 3.1 | 0.1 | 64.4 | 0.057 |
| F4 | 74 | 5 | 5 | 40 | 34 | 0 | 2.9 | 1.8 | 1.4 | 70.0 | 0.018 |
| G1 | 67 | 10 | 2 | 43 | 24 | 0 | 3.6 | 2.4 | 0.2 | 84.2 | 0.043 |
| G2 | 67 | 10 | 2 | 55 | 12 | 0 | 6.4 | 2.5 | 0.3 | 79.3 | 0.040 |
| H1 | 58 | 16 | 7 | 30 | 28 | 0 | 8.3 | 2.9 | 0.1 | 69.6 | 0.040 |
| H2 | 58 | 16 | 7 | 20 | 38 | 0 | 4.4 | 2.6 | 0.3 | 78.2 | 0.045 |
| H3 | 77 | 0 | 7 | 37 | 40 | 0 | 3.1 | 2.0 | 1.2 | 87.1 | 0.013 |
| H4 | 48 | 15 | 7 | 30 | 18 | 0 | 4.5 | 2.6 | 1.1 | 78.2 | 0.014 |
| I1 | 50 | 16 | 8 | 37 | 13 | 0 | 6.3 | 2.5 | 0.3 | 79.3 | 0.030 |
| I2 | 52 | 16 | 7 | 38 | 14 | 0 | 7.2 | 2.9 | 0.4 | 70.0 | 0.051 |
| J1 | 46 | 19 | 8 | 35 | 11 | 0 | 6.9 | 2.7 | 0.8 | 75.3 | 0.038 |
| J2 | 47 | 21 | 7 | 33 | 14 | 0 | 3.0 | 2.4 | 2.0 | 84.2 | 0.200 |
| K1 | 39 | 24 | 10 | 29 | 10 | 0 | 9.2 | 2.4 | 0.3 | 73.9 | 0.050 |

The cells having an underline do not satisfy the conditions according to the present invention.

TABLE 7

| Steel sheet | Area ratio of F + B % | Area ratio of γ % | Area ratio of M % | Area ratio of F % | Area ratio of B + M' % | Area ratio of P % | Grain size of F μm | Grain size of γ μm | Particle size of θ μm | Spheroidized ratio % | Density of θ particles/μm |
|---|---|---|---|---|---|---|---|---|---|---|---|
| L1 | 68 | 10 | 4 | 28 | 40 | 1 | 5.4 | 3.5 | 0.2 | 56.4 | 0.052 |
| L2 | 68 | 10 | 2 | 55 | 13 | 0 | 3.4 | 2.2 | 0.3 | 81.2 | 0.037 |
| M1 | 53 | 14 | 10 | 40 | 13 | 3 | 9.4 | 3.7 | 0.3 | 54.5 | 0.047 |
| M2 | 51 | 15 | 6 | 40 | 11 | 0 | 5.3 | 2.7 | 1.2 | 75.3 | 0.170 |
| N1 | 51 | 15 | 12 | 23 | 28 | 3 | 5.2 | 3.7 | 0.3 | 54.5 | 0.052 |
| N2 | 48 | 15 | 7 | 34 | 14 | 0 | 4.7 | 2.2 | 0.2 | 89.2 | 0.067 |
| O1 | 56 | 13 | 9 | 40 | 16 | 2 | 7.0 | 3.9 | 0.4 | 51.3 | 0.051 |
| O2 | 56 | 13 | 5 | 40 | 16 | 0 | 3.0 | 2.4 | 0.3 | 84.2 | 0.067 |
| P1 | 63 | 11 | 5 | 46 | 17 | 1 | 11.0 | 3.6 | 0.2 | 55.1 | 0.094 |
| P2 | 62 | 12 | 3 | 30 | 32 | 0 | 7.1 | 2.2 | 0.3 | 79.4 | 0.056 |
| Q1 | 53 | 14 | 11 | 40 | 13 | 2 | 5.8 | 3.7 | 0.5 | 54.5 | 0.044 |
| Q2 | 54 | 14 | 5 | 39 | 15 | 0 | 4.2 | 2.3 | 0.5 | 87.5 | 0.043 |
| R1 | 57 | 17 | 9 | 37 | 20 | 2 | 4.0 | 3.9 | 0.3 | 51.3 | 0.040 |
| R2 | 57 | 17 | 4 | 28 | 29 | 0 | 6.8 | 2.4 | 1.4 | 84.2 | 0.190 |
| S1 | 52 | 19 | 11 | 35 | 17 | 4 | 9.5 | 4.1 | 0.4 | 67.0 | 0.056 |
| S2 | 51 | 20 | 6 | 37 | 14 | 0 | 4.2 | 2.7 | 0.3 | 75.3 | 0.040 |
| T1 | 56 | 13 | 9 | 40 | 16 | 2 | 6.3 | 3.7 | 0.4 | 54.5 | 0.054 |
| T2 | 55 | 13 | 5 | 38 | 17 | 0 | 3.8 | 2.2 | 0.4 | 89.6 | 0.057 |
| U1 | 71 | 9 | 3 | 58 | 13 | 2 | 7.9 | 3.7 | 0.3 | 54.5 | 0.057 |
| V1 | 62 | 12 | 6 | 49 | 13 | 3 | 6.5 | 4.1 | 0.4 | 60.0 | 0.047 |
| a1 | 47 | 21 | 15 | 32 | 15 | 0 | 5.9 | 2.5 | 1.4 | 79.3 | 0.180 |
| b1 | 69 | 1 | 2 | 32 | 37 | 0 | 4.0 | 2.5 | 0.1 | 79.3 | 0.042 |
| c1 | 61 | 12 | 3 | 50 | 11 | 2 | 5.4 | 2.5 | 0.3 | 79.3 | 0.053 |
| d1 | 56 | 13 | 4 | 45 | 11 | 0 | 6.4 | 2.5 | 0.2 | 79.3 | 0.030 |
| e1 | 37 | 5 | 23 | 20 | 17 | 0 | 8.9 | 3.9 | 0.4 | 51.3 | 0.010 |
| f1 | 58 | 1 | 4 | 37 | 21 | 0 | 5.6 | 2.5 | 2.0 | 79.3 | 0.200 |
| g1 | 53 | 19 | 5 | 20 | 33 | 0 | 5.2 | 2.5 | 0.2 | 79.3 | 0.050 |

The cells having an underline do not satisfy the conditions according to the present invention.

TABLE 8

| Steel | 2X + Y — | {110}<111>/{110}<001> — | TS N/mm$^2$ | tEL % | $tEL_{150}$ % | E — | uEL % | λ % |
|---|---|---|---|---|---|---|---|---|
| A1 | 8.0 | 1.4 | 1312 | 17.6 | 23.0 | 1.9 | 15.4 | 34.7 |
| A2 | 8.1 | 2.2 | 1300 | 17.7 | 23.1 | 1.7 | 14.4 | 37.5 |
| A3 | 5.0 | 2.1 | 1380 | 12.9 | 13.0 | −6.3 | 9.9 | 30.0 |
| B1 | 8.4 | 2.2 | 753 | 28.4 | 41.8 | 5.7 | 24.3 | 38.2 |
| B2 | 7.9 | 1.8 | 773 | 27.7 | 40.6 | 5.0 | 23.3 | 38.8 |

TABLE 8-continued

| Steel | 2X + Y — | {110}<111>/ {110}<001> — | TS N/mm² | tEL % | $tEL_{150}$ % | E — | uEL % | λ % |
|---|---|---|---|---|---|---|---|---|
| B3 | 8.4 | 1.3 | 1523 | 12.0 | 12.0 | −3.4 | 10.0 | 15.0 |
| C1 | 1.5 | 1.6 | 614 | 34.1 | 45.0 | 5.0 | 29.1 | 39.2 |
| C2 | 6.7 | 2.1 | 654 | 32.2 | 42.5 | 3.6 | 26.9 | 39.8 |
| D1 | 6.2 | 2.1 | 1044 | 21.3 | 30.0 | 1.7 | 18.7 | 35.9 |
| D2 | 9.2 | 1.4 | 1029 | 21.6 | 31.5 | 2.7 | 18.6 | 36.6 |
| D3 | 6.9 | 1.6 | 1100 | 14.4 | 20.7 | −6.1 | 10.9 | 58.3 |
| E1 | 11.1 | 1.7 | 824 | 26.2 | 38.1 | 3.8 | 22.7 | 37.4 |
| E2 | 6.3 | 2.0 | 790 | 27.2 | 39.8 | 4.6 | 23.6 | 37.5 |
| F1 | 8.2 | 1.5 | 1013 | 23.3 | 33.3 | 4.2 | 20.2 | 34.2 |
| F2 | 6.2 | 2.0 | 990 | 23.7 | 34.0 | 4.2 | 21.4 | 33.1 |
| F3 | 4.9 | 1.5 | 1009 | 15.0 | 18.1 | −11.1 | 9.0 | 38.0 |
| F4 | 10.7 | 7.4 | 992 | 15.7 | 25.8 | −3.9 | 8.2 | 32.0 |
| G1 | 10.2 | 1.7 | 634 | 33.1 | 45.1 | 5.7 | 29.5 | 37.4 |
| G2 | 6.0 | 2.2 | 620 | 33.8 | 45.9 | 6.2 | 28.3 | 39.9 |
| H1 | 7.0 | 2.2 | 1189 | 19.1 | 26.6 | 2.2 | 16.7 | 35.3 |
| H2 | 7.3 | 1.6 | 1188 | 19.1 | 25.6 | 1.2 | 15.5 | 38.0 |
| H3 | 7.3 | 2.2 | 1200 | 15.0 | 15.0 | −9.1 | 9.0 | 30.0 |
| H4 | 10.7 | 2.1 | 1170 | 17.4 | 18.4 | −6.6 | 14.3 | 28.0 |
| I1 | 6.8 | 1.9 | 1239 | 18.4 | 25.9 | 2.8 | 15.0 | 37.8 |
| I2 | 6.3 | 1.5 | 1199 | 19.0 | 26.5 | 2.3 | 15.4 | 37.9 |
| J1 | 8.9 | 1.2 | 1230 | 19.3 | 28.2 | 4.9 | 16.8 | 33.9 |
| J2 | 6.3 | 2.0 | 1210 | 18.1 | 20.1 | −3.7 | 15.9 | 26.0 |
| K1 | 4.8 | 1.2 | 1433 | 17.6 | 23.5 | 5.7 | 15.6 | 31.2 |

The cells having an underline do not satisfy the conditions according to the present invention.

TABLE 9

| Steel | 2X + Y — | {110}<111>/ {110}<001> — | TS N/mm² | tEL % | $tEL_{150}$ % | E — | uEL % | λ % |
|---|---|---|---|---|---|---|---|---|
| L1 | 7.8 | 1.4 | 601 | 34.8 | 51.0 | 10.8 | 31.0 | 37.5 |
| L2 | 9.1 | 2.2 | 599 | 34.9 | 49.2 | 8.9 | 31.2 | 37.5 |
| M1 | 9.6 | 1.6 | 1020 | 21.8 | 29.9 | 0.9 | 19.1 | 36.0 |
| M2 | 5.3 | 1.2 | 1080 | 19.7 | 21.7 | −5.6 | 16.5 | 23.0 |
| N1 | 7.9 | 2.2 | 1088 | 20.6 | 28.7 | 1.5 | 17.7 | 36.3 |
| N2 | 6.6 | 2.0 | 1170 | 19.4 | 27.0 | 2.1 | 15.7 | 38.1 |
| O1 | 6.1 | 1.9 | 941 | 23.3 | 33.9 | 2.8 | 20.1 | 36.9 |
| O2 | 7.8 | 1.1 | 950 | 23.1 | 34.1 | 3.3 | 19.3 | 38.2 |
| P1 | 8.4 | 1.7 | 739 | 28.9 | 45.4 | 8.9 | 23.9 | 39.6 |
| P2 | 9.1 | 1.7 | 780 | 27.5 | 41.7 | 6.2 | 23.5 | 38.2 |
| Q1 | 7.4 | 1.2 | 1039 | 21.4 | 31.1 | 2.6 | 17.8 | 37.9 |
| Q2 | 8.2 | 1.2 | 1001 | 22.1 | 32.2 | 2.8 | 18.4 | 38.0 |
| R1 | 9.5 | 1.1 | 927 | 25.0 | 37.7 | 6.2 | 22.9 | 33.0 |
| R2 | 8.3 | 1.4 | 900 | 23.7 | 25.7 | −6.5 | 20.9 | 18.0 |
| S1 | 6.7 | 2.2 | 1065 | 22.3 | 31.9 | 4.1 | 19.6 | 33.5 |
| S2 | 7.1 | 1.8 | 1100 | 21.7 | 31.4 | 4.6 | 19.8 | 32.1 |
| T1 | 8.2 | 2.2 | 951 | 23.1 | 34.7 | 3.8 | 18.9 | 38.9 |
| T2 | 4.8 | 1.8 | 960 | 22.9 | 34.4 | 3.9 | 19.4 | 37.5 |
| U1 | 6.5 | 1.3 | 515 | 40.1 | 65.8 | 23.2 | 34.5 | 39.4 |
| V1 | 7.5 | 1.6 | 779 | 27.6 | 41.2 | 5.7 | 22.8 | 39.5 |
| a1 | 8.2 | 2.0 | 1220 | 15.0 | 20.6 | −3.0 | 12.8 | 30.0 |
| b1 | 5.5 | 1.6 | 551 | 31.2 | 31.2 | −10.4 | 8.7 | 39.0 |
| c1 | 8.4 | 2.7 | 807 | 16.7 | 25.0 | −9.7 | 12.0 | 34.0 |
| d1 | 5.3 | 2.7 | 942 | 17.3 | 26.9 | −4.1 | 13.4 | 31.0 |
| e1 | 7.1 | 1.1 | 1510 | 8.9 | 15.4 | −0.4 | 7.0 | 32.0 |
| f1 | 9.6 | 1.7 | 881 | 18.8 | 20.8 | −11.9 | 12.0 | 26.0 |
| g1 | 9.0 | 2.7 | 1044 | 17.7 | 26.4 | −1.9 | 15.2 | 29.0 |

The cells having an underline do not satisfy the conditions according to the present invention.

The steel sheets of Examples were all excellent in terms of the balance between strength and formability (elongation and hole expansion). In addition, the steel sheet E2 had a small in-plane anisotropy during forming compared to the steel sheet E1.

For the steel sheet A3, since the annealing conditions (annealing parameter P) did not satisfy the above equation (4), the average particle size of cementite exceeded 1 μm, and the spheroidized ratio of cementite was less than 30%. Therefore, sufficient formability could not be secured. In addition, the total of the reduction in thickness of the last two steps in hot rolling was small, and the average grain size of retained austenite was large compared to the steel sheets A1 and A2.

For the steel sheet B3, since the average heating temperature of annealing (annealing temperature) exceeded 900° C., the area ratio of retained austenite was less than 2%, the area ratio of martensite exceeded 20%, and the spheroidized ratio of cementite was less than 30%. Therefore, the tensile strength TS excessively increased, and sufficient formability could not be secured.

For the steel sheet D3, since the average heating temperature of annealing was lower than 750° C., the area ratio of retained austenite was less than 2%. Therefore, sufficient formability could not be secured.

For the steel sheet F3, since the holding temperature was lower than 300° C., the area ratio of retained austenite was less than 2%. Therefore, sufficient formability could not be secured.

For the steel sheet F4, since the holding temperature exceeded 500° C., the average particle size of cementite exceeded 1 μm. Therefore, sufficient formability could not be secured.

For the steel sheet H3, since the reduction in thickness of cold rolling exceeded 85%, and the holding time exceeded 1200 seconds, the area ratio of retained austenite was less than 2%, and the average particle size of cementite exceeded 1 μm. Therefore, sufficient formability could not be secured.

For the steel sheets H4 and R2, since the average cooling rate in the front cooling zone was less than 15° C., and the annealing conditions did not satisfy the above equation (4) in cooling after hot rolling, the average particle size of cementite exceeded 1 μm. Therefore, sufficient formability could not be secured.

For the steel sheets J2 and M2, since the coiling temperature exceeded 600° C., and the annealing conditions did not satisfy the above equation (4), the average particle size of cementite exceeded 1 μm. Therefore, sufficient formability could not be secured.

For the steel sheets a1 to g1 which were manufactured using steels a to g, the chemical components were not appropriate. For the steel sheet a1 (steel a), the amount of C exceeded 0.40%, and the average particle size of cementite exceeded 1%. For the steel sheet b1 (steel b), the amount of C was less than 0.10%, and the area ratio of retained austenite was less than 2%. For the steel sheet c1 (steel c), the amount of P exceeded 0.05%, and the amount of S exceeded 0.02%. For the steel sheet d1 (steel d), the amount of Si exceeded 2.5%. For the steel sheet e1 (steel e), the amount of Mn exceeded 4.0%, and the area ratio of martensite exceeded 20%. For the steel sheet f1 (steel f), the amount of Si was less than 0.005%, the area ratio of austenite was less than 2%, and the average particle size of cementite exceeded 1 μm. For the steel sheet g1 (steel g), the amount of A1 exceeded 2.5%, and the amount of Mo exceeded 0.3%. Therefore, for these steel sheets a1 to g1, the balance between strength and formability deteriorated.

Figure 8:
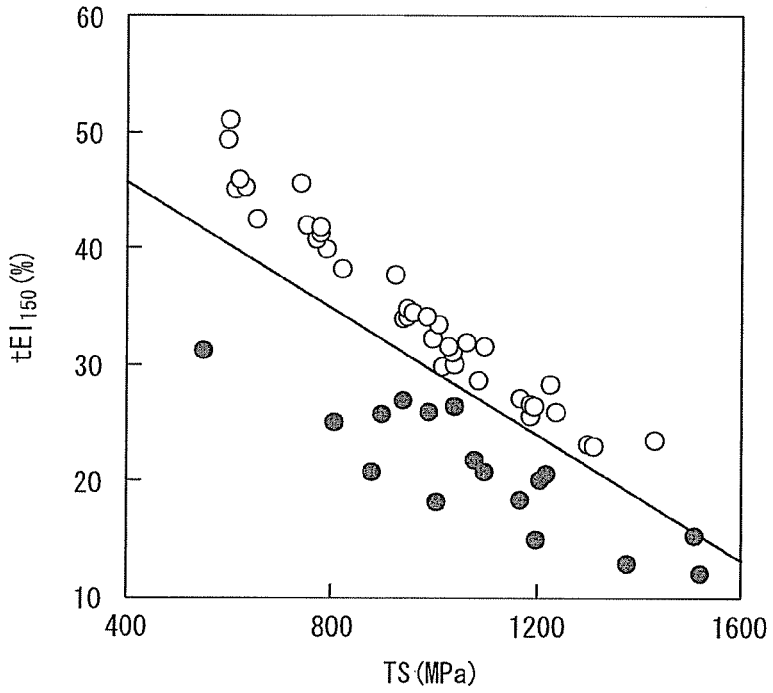
FIG. 8 is a view showing the relationship between tensile strength TS and elongation $tEL_{150}$ at 150° C. in Examples and Comparative Examples.

Here, the relationship between tensile strength and elongation at 150° C. will be described. FIG. 8 is a view showing the relationship between tensile strength TS (N/mm$^2$) and elongation at 150° C. $tEL_{150}$(%). Meanwhile, in FIG. 8, the values of tensile strength TS and elongation at 150° C. $tEL_{150}$ that are shown in Tables 6 to 9 are used.

As is clear from FIG. 8, it could be confirmed that, in a case in which the same tensile strength as for Comparative Examples was obtained, the steel sheets of Examples had an extremely high elongation at 150° C. compared to Comparative Examples.

In addition, the steel sheets of Examples included in the area above the straight line of the equation (13) shown in FIG. 8.

$$tEL_{150}=-0.027Ts+56.5 \quad (13)$$

The straight line indicates the balance between strength and formability, and thus is obtained from the results in FIG. 8.

The characteristic index E shown by the above equation (12) in Tables 4 and 5 refers to an index showing the balance between strength and elongation as described above. When the value of the characteristic index E is positive, the values of the tensile strength and elongation at 150° C. of the steel sheets are included in the area above the equation (13) in FIG. 8. When the value of the characteristic index E is negative, the values of the tensile strength and elongation at 150° C. of the steel sheets are included in the area below the equation (13) in FIG. 8.

Meanwhile, the above examples are simply exemplified embodiments of the present invention, and to the steel sheet according to the present invention and the method of manufacturing the same, a variety of modifications can be added within the scope of the claims.

For example, a variety of treatments can be carried out on the steel sheet according to the present invention as long as the treatments do not change the size of cementite. That is, the steel sheet according to the present invention may be any of a cold-rolled steel sheet as it is cold-rolled, a galvanized steel sheet, a galvannealed steel sheet, and an electroplated steel sheet, and, even in a case in which a variety of treatments are carried out, the effects of the present invention can be obtained.

In addition, the present invention is rarely influenced by casting conditions. For example, a casting method (continuous casting or ingot casting) or a difference in slab thickness has a small influence, and, even in a case in which a special casting and hot rolling method, such as thin slab, is used, the effects of the present invention can be obtained.

Industrial Applicability

According to the present invention, it is possible to impart favorable formability to a subject to be formed when a process, such as forming using a press, is carried out, and to obtain favorable formability even in a case in which the weight of structure of automobile body is decreased using a high-strength steel sheet is used.

What is claimed is:

1. A high-strength cold-rolled steel sheet comprising: by mass%,

C: 0.10% to 0.40%;

Mn: 0.5% to 4.0%;

Si: 0.005% to 2.5%;

Al: 0.005% to 2.5%;

Cr: 0% to 1.0%; and a balance of iron and inevitable impurities, wherein an amount of P is limited to 0.05% or less, an amount of S is limited to 0.02% or less, an amount of N is limited to 0.006% or less, a microstructure thereof includes 2% to 30% of retained austenite by area percentage, martensite is limited to 20% or less by area percentage in the microstructure, an average particle size of cementite in the microstructure is 0.01 μm to 1 μm, and 30% to 100% of the cementite has an aspect ratio of 1 to 3.

2. The high-strength cold-rolled steel sheet according to claim 1, further comprising, by mass %, one or more kinds of:

Mo: 0.01% to 0.3%;

Ni: 0.01% to 5%;

Cu: 0.01% to 5%;

B: 0.0003% to 0.003%;

Nb: 0.01% to 0.1%;

Ti: 0.01% to 0.2%;

V: 0.01% to 1.0%;

W: 0.01% to 1.0%;

Ca: 0.0001% to 0.05%;

Mg: 0.0001% to 0.05%;

Zr: 0.0001% to 0.05%; and

REM: 0.0001% to 0.05%.

3. The high-strength cold-rolled steel sheet according to claim 1, wherein a total amount of Si and Al is 0.5% to 2.5%.

4. The high-strength cold-rolled steel sheet according to claim 1, wherein an average grain size of the retained austenite is 5 μm or less.

5. The high-strength cold-rolled steel sheet according to claim 1, wherein the microstructure includes, by area percentage, 10% to 70% of ferrite.

6. The high-strength cold-rolled steel sheet according to claim 1, wherein the microstructure includes, by area percentage, 10% to 70% of ferrite and bainite in total.

7. The high-strength cold-rolled steel sheet according to claim 1 wherein the microstructure includes, by area percentage, 10% to 75% of bainite and tempered martensite in total.

8. The high-strength cold-rolled steel sheet according to claim 1, wherein an average grain diameter of the ferrite is 10 μm or less.

9. The high-strength cold-rolled steel sheet according to claim 5 or 6 wherein 0.003 to 0.12 particles of the cementite having the aspect ratio of 1 to 3 is included in an area of 1 $\mu m^2$.

10. The high-strength cold-rolled steel sheet according to claim 1, wherein, in a central portion of a sheet thickness thereof, a random intensity ratio X of a {100} <001>orientation of the retained austenite and the average value Y of a random intensity ratio of a {110} <111>to {110} <001>orientation group of the retained austenite satisfies a following equation (14), $$4<2X+Y<10 \quad (14).$$

11. The high-strength cold-rolled steel sheet according to claim 1 wherein, in a central portion of a sheet thickness thereof, the ratio of the random intensity ratio of a {110} <111>orientation of the retained austenite to a random intensity ratio of a {110} <001>orientation of the retained austenite is 3.0 or less.

12. The high-strength cold-rolled steel sheet according to claim 1, further comprising a zinc coating on at least one surface thereof.

13. The high-strength cold-rolled steel sheet according to claim 1, further comprising a galvannealed coating on at least one surface thereof.

14. A method of manufacturing a high-strength cold-rolled steel sheet, the method comprising:

a first process in which a slab having the chemical composition according to claim 1 is hot-rolled at a finishing temperature of 820° C. or higher so as to produce a hot-rolled steel sheet;

a second process in which, after the first process, the hot-rolled steel sheet is cooled and coiled in a coiling temperature CT° C. of 350° C. to 600° C.;

a third process in which the hot-rolled steel sheet that has undergone the second process is cold-rolled in a reduction in thickness of 30% to 85% so as to produce a cold-rolled steel sheet;

a fourth process in which, after the third process, the cold-rolled steel sheet is heated and annealed at an average heating temperature of 750° C. to 900° C.;

a fifth process in which the cold-rolled steel sheet that has undergone the fourth process is cooled at an average cooling rate of 3 ° C/s to 200 ° C/s and held in a temperature range of 300° C. to 500° C. for 15 seconds to 1200 seconds; and a sixth process in which the cold-rolled steel sheet that has undergone the fifth process is cooled, wherein in the second process, a first average cooling rate CR1° C/s from 750° C. to 650° C. is 15 ° C/s to 100 ° C/s, a second average cooling rate CR2° C/s from 650° C. to the coiling temperature CT° C. is 50 ° C/s or less, a third average cooling rate CR3° C/s from after coiling to 150° C. is 1 ° C/s or less, and the coiling temperature CT° C. and the first average cooling rate CR1° C/s satisfy a following equation (15), and in the fourth process, in a case in which the amounts of Si, Al, and Cr are represented by [Si], [Al], and [Cr] in terms of mass%, respectively, an average area S $\mu m^2$ of pearlite included in the hot-rolled steel sheet that has undergone the second process, the average heating temperature T° C., and a heating time t satisfy a relationship of a following equation (16), $$1500 < CR1 \times (650 - CT) < 15000 \quad (15)$$

$$2200 > T \times \log(t)/(1 + 0.3[Si] + 0.5[Al] + [Cr] + 0.5S) > 110 \quad (16).$$

15. The method of manufacturing the high-strength cold-rolled steel sheet according to claim 14, wherein a total of the reduction in thickness of last two steps in the first process is 15% or more.

16. The method of manufacturing the high-strength cold-rolled steel sheet according to claim 14, wherein the cold-rolled steel sheet that has undergone the fifth process and is to undergo the sixth process is coated with zinc.

17. The method of manufacturing the high-strength cold-rolled steel sheet according to claim 14, wherein the cold-rolled steel sheet that has undergone the fifth process and is to undergo the sixth process is galvanized and annealed in 400° C. to 600° C. for alloying.

18. The method of manufacturing the high-strength cold-rolled steel sheet according to claim 14, wherein an average heating rate from 600° C. to 680° C. in the fourth process is 0.1 ° C/s to 7° C/s.

19. The method of manufacturing the high-strength cold-rolled steel sheet according to claim 14, wherein, before the first process, the slab is cooled to 1000° C. or lower and reheated to 1000° C. or higher.

* * * * *

UNITED STATES PATENT AND TRADEMARK OFFICE

CERTIFICATE OF CORRECTION

PATENT NO. : 8,951,366 B2
APPLICATION NO. : 13/574096
DATED : February 10, 2015
INVENTOR(S) : Sano et al.

It is certified that error appears in the above-identified patent and that said Letters Patent is hereby corrected as shown below:

In the specification

Column 4, lines 8-9, change "heating time is satisfy" to -- heating time ts satisfy --;

Column 7, lines 52-53, change "a in the equation (5)" to -- α in the equation (5) --;

Column 27, line 18, change "hole expansion λ, were evaluated" to -- hole expansion λ were evaluated --;

In the claims

Column 35, line 26, Claim 7, change "claim 1" to -- claim 1, --;

Column 35, line 30, Claim 8, change "claim 1," to -- claim 5 or 6, --;

Column 35, line 35, Claim 9, change "claim 5 or 6" to -- claim 1, --; and

Column 36, line 37, Claim 14, change "1500<CR1x(650-CT) <15000" to -- 1500≤CR1x(650-CT) ≤15000 --.

Signed and Sealed this
Twenty-fourth Day of November, 2015

Michelle K. Lee

Michelle K. Lee
*Director of the United States Patent and Trademark Office*